US011607365B2

(12) United States Patent
Matsushita

(10) Patent No.: US 11,607,365 B2
(45) Date of Patent: Mar. 21, 2023

(54) BEAUTY DEVICE

(71) Applicant: MTG CO., LTD., Aichi-ken (JP)

(72) Inventor: Tsuyoshi Matsushita, Nagoya (JP)

(73) Assignee: MTG CO., LTD., Aichi-ken (JP)

( * ) Notice: Subject to any disclaimer, the term of this patent is extended or adjusted under 35 U.S.C. 154(b) by 104 days.

(21) Appl. No.: 16/472,654

(22) PCT Filed: Sep. 28, 2017

(86) PCT No.: PCT/JP2017/035339
§ 371 (c)(1),
(2) Date: Aug. 15, 2019

(87) PCT Pub. No.: WO2018/123176
PCT Pub. Date: Jul. 5, 2018

(65) Prior Publication Data

US 2020/0383867 A1 Dec. 10, 2020

(30) Foreign Application Priority Data

Dec. 26, 2016 (JP) ..... JP2016-251516

(51) Int. Cl.
*A61H 15/00* (2006.01)

(52) U.S. Cl.
CPC ... *A61H 15/0085* (2013.01); *A61H 2015/005* (2013.01); *A61H 2201/1676* (2013.01)

(58) Field of Classification Search
CPC ..... A61H 7/003; A61H 7/005; A61H 7/007; A61H 15/0085; A61H 15/0092;
(Continued)

(56) References Cited

U.S. PATENT DOCUMENTS 2,011,471 A * 8/1935 Casagrande ..... A61H 15/0092 601/129
2,577,129 A 12/1951 Johnson et al.
(Continued)

FOREIGN PATENT DOCUMENTS

CN 1262609 8/2000
CN 201814806 U 5/2011
(Continued)

OTHER PUBLICATIONS

Extended European Search Report issued in corresponding European patent application EP 17 88 7040.8 dated Aug. 27, 2020.
(Continued)

*Primary Examiner* — Colin W Stuart
*Assistant Examiner* — Douglas Y Sul
(74) *Attorney, Agent, or Firm* — Greenblum & Bernstein, P.L.C.

(57) ABSTRACT

A beauty device that provides a desired massage effect in a simple and efficient manner is provided. The beauty device includes a main body including a handle portion to be held by a user, an arm portion provided to be pivotal relative to the main body, two rollers rotationally held by the arm portion, and an urging mechanism that urges the arm portion toward a reference position within a range of the pivot movement. The beauty device efficiently provides a desired massage effect simply by pressing the two rollers against the skin and moving the rollers to reciprocate without greatly changing the position of the handle portion with respect to the skin in any of advancing directions including the forward path and the return path.

10 Claims, 28 Drawing Sheets

(58) Field of Classification Search
CPC ..... A61H 2015/00; A61H 2015/0014; A61H 2015/0042; A61H 2015/005; A61H 2015/0057; A61H 2201/1253; A61H 2201/0153; A61H 2201/1676; B26B 21/52; B26B 21/521
See application file for complete search history.

(56) References Cited

U.S. PATENT DOCUMENTS

| | | | | |
|---|---|---|---|---|
| 2,633,844 | A * | 4/1953 | Herndon | A61H 15/0092 601/128 |
| 4,825,853 | A * | 5/1989 | Iwamoto | A61H 23/0263 601/72 |
| 5,997,489 | A * | 12/1999 | Iwamoto | A61H 15/0092 601/73 |
| 6,436,062 | B1 | 8/2002 | Iwamoto et al. | |
| 10,206,848 | B2 * | 2/2019 | Matsushita | A61N 1/26 |
| 10,327,981 | B1 * | 6/2019 | Ayotte | A61H 15/0092 |
| 2006/0276732 | A1 * | 12/2006 | Chen | A61H 15/0092 601/113 |
| 2012/0209363 | A1 * | 8/2012 | Williams, III | A61F 7/02 607/114 |
| 2012/0311865 | A1 * | 12/2012 | Hamilton | B23K 26/348 30/32 |
| 2013/0245509 | A1 * | 9/2013 | Tanigawa | F16C 17/10 601/20 |
| 2014/0288473 | A1 * | 9/2014 | Matsushita | A61H 15/0085 601/137 |
| 2015/0266191 | A1 * | 9/2015 | Maimone | B26B 21/528 30/527 |

FOREIGN PATENT DOCUMENTS

| | | | |
|---|---|---|---|
| CN | 103750992 | | 4/2014 |
| DE | 4300219 | | 7/1994 |
| FR | 618121 | | 3/1927 |
| JP | 11-342171 | | 12/1999 |
| JP | 2007-130327 | | 5/2007 |
| JP | 2012-105701 | | 6/2012 |
| JP | 2013-34694 | | 2/2013 |
| JP | 2013034694 | A * | 2/2013 |
| WO | 2013/070632 | | 5/2013 |
| WO | 2014/054450 | | 4/2014 |

OTHER PUBLICATIONS

Official Communication issued in International Patent Application No. PCT/JP2017/035339, dated Dec. 19, 2017.
Office Action, European Patent Office, Application No. 17887040.8, dated Jun. 22, 2021.
Official Action, China Patent Office, in counterpart Chinese Patent Application No. 201780080301.1, dated Dec. 7, 2021 (with English translation).
Office Action, Korean Patent Office, in counterpart Korean Patent Application No. 10-2019-7021647, dated Apr. 20, 2022, (with English translation).

* cited by examiner

BEAUTY DEVICE

TECHNICAL FIELD

The present invention relates to a beauty device.

BACKGROUND ART

There has been a known beauty device having its rollers rotated while being pressed against the skin for skin beauty treatment. A beauty device of this kind includes a handle and rollers rotationally attached to the handle, and a body part of the user is pinched between the adjacent rollers during use.

For example, Patent Document 1 discloses a beauty device having a main body forked into two branches and rollers attached to the tip ends of the main body, and the rotation axes of the two rollers form a spreading shape such that the distance between the rotation axes increases as the distance from the main body increases. The beauty device can knead skin as if to pick up the skin between the two rollers by pulling the main body while keeping the rollers pressed against the skin. As a result, a high massage effect is provided.

Patent Document 2 discloses a massage device including a pair of bearing arms opposed to each other at the upper end of a rod-shaped handle and a rotation portion including two axially rotational spherical bodies supported between the pair of bearing arms in a vertically rotational manner. The bearing arms are provided with a rotation locking portion configured to press the rotation portion against the bearing arms into contact with each other under pressure and fix the rotation portion so that the rotation portion is prevented from rotating in the vertical direction, and the locking by the rotation locking portion can be selectively canceled.

PRIOR ART DOCUMENTS

Patent Documents

Patent Document 1: Japanese Laid-Open Patent Publication No. 2007-130327 Patent Document 2: Japanese Laid-Open Patent Publication No. 2013-34694

SUMMARY OF THE INVENTION

Problems that the Invention is to Solve

As for the manner of using the beauty device of this kind, the simplest way is to move the beauty device in a reciprocating manner while keeping the rollers pressed against the skin. However, when the beauty device is moved to reciprocate, the rotating direction of the rollers in the forward path is reversed from the rotating direction of the rollers in the return path. The angles of the rotation axes of the rollers with respect to the skin change as the moving direction of the beauty device is reversed. Therefore, a desired massage effect may not be provided in either of the paths.

The beauty device disclosed in Patent Document 1 provides a massage effect achieved by picking up the skin when the main body is pulled. However, when the main body is moved in the opposite direction from the above, the skin between the pair of the rollers is pressed and spread, and the massage effect achieved by picking up the skin cannot be provided.

The massage device disclosed in Patent Document 2 is used while the rotation of the rotation portion is locked by the rotation locking portion. Therefore, the angle of the rotation portion with respect to the skin surface, in other words the angles of the rotation axes of the special bodies are different between the forward and return paths, and it may be difficult to provide a desired massage effect in both of the forward and return paths.

In this way, when the conventional beauty devices are moved in a reciprocating manner while being kept in a constant position with respect to the skin, a desired massage effect is substantially provided only for one of the forward and return paths. In order to achieve a desired massage effect both in the forward and return paths, the position of the beauty device must be changed greatly between the forward and return paths, or the position for holding the beauty device must be changed.

Accordingly, it is an object of the present invention to provide a beauty device that provides a desired massage effect in a simple and efficient manner.

Means for Solving the Problems

In accordance with one aspect of the present invention, a beauty device is provided that includes;

a main body including a handle portion to be held by a user;

an arm portion provided to be pivotal relative to the main body; two rollers rotationally held at the arm portion; and an urging mechanism that urges the arm portion toward a reference position within a range of the pivot movement.

Effects of the Invention

The beauty device has an arm portion provided to be pivotal relative to the main body, and two rollers rotationally held by the arm portion. The arm portion is urged toward the reference position within the range of the pivot movement by the urging mechanism.

As a result of the configuration, the beauty device allows the arm portion and the two rollers held by the arm portion to pivot relative to the main body. The arm portion and the two rollers moved by the pivot movement are urged toward the reference position. In this way, the beauty device efficiently provides a desired massage effect through the simple operation of moving the two rollers to reciprocate while pressing the two rollers against the skin without significantly changing the position of the handle portion with respect to the skin when the device is advanced in either of the forward and return paths.

More specifically, when the beauty device is advanced in the forward path, the arm portion and the two rollers pivot rearward beyond the reference position against the urging force of the urging mechanism. This allows the rotation axis of each of the rollers to be inclined rearward relative to the rotation axis in the reference position. When the beauty device is further advanced from the state, the two rollers are rotated, so that a desired massage effect such as kneading while picking up the skin between the two rollers is provided.

When the two rollers are pivoted in a direction away from the reference position against the urging force of the urging mechanism, the two rollers will return to the reference position by the urging force of the urging mechanism. Therefore, the two rollers are spontaneously returned to the reference position by the urging force by moving the beauty device rearward upon completing the movement in the forward path and turning back in the return path. The two rollers are allowed to pivot reversely from the pivot direction in the forward path by further moving the beauty device backward from the state.

In the return path, the pivot movement of the rollers causes the rotation axis of each of the rollers to be inclined forward relative to the rotation axis in the reference position. When the beauty device is moved backward in the state, the two rollers are rotated reversely from the forward path. In this way, in the return path, the rotation axis of the roller is inclined reversely from the forward path, and the two rollers are rotated reversely from the forward path, so that the same massage effect as in the forward path is provided without significantly changing the position of the handle portion with respect to the skin.

When turning back to the forward path from the return path, the two rollers are spontaneously pivoted rearward behind the reference position as the beauty device advances similarly to the turning back from the forward path to the return path, and the rotation axis of each of the rollers is inclined rearward with respect to the rotation axis in the reference position.

Therefore, when the beauty device is used in the simplest manner in which the device is moved to reciprocate while keeping the position of the handle portion with respect to the skin substantially constant, the rotation axis is easily inclined in the same direction in either of the forward and return paths with respect to the skin ahead of the rollers in the advancing direction. As a result, a desired massage effect is provided in either of the forward and return paths.

When the positional relationship including the distance between the beauty device and the skin or the angle formed between the rotation axis and the skin changes during the reciprocation, the urging mechanism of the beauty device buffers the change. In this way, when the positional relationship changes, the force to be applied from the two rollers to the skin can be adjusted to an appropriate level. As a result, the comfortability in use of the beauty device is even more improved to a higher level.

As in the foregoing, the beauty device provides a desired massage effect in a simple and efficient manner.

MODES FOR CARRYING OUT THE INVENTION

Figure 1:
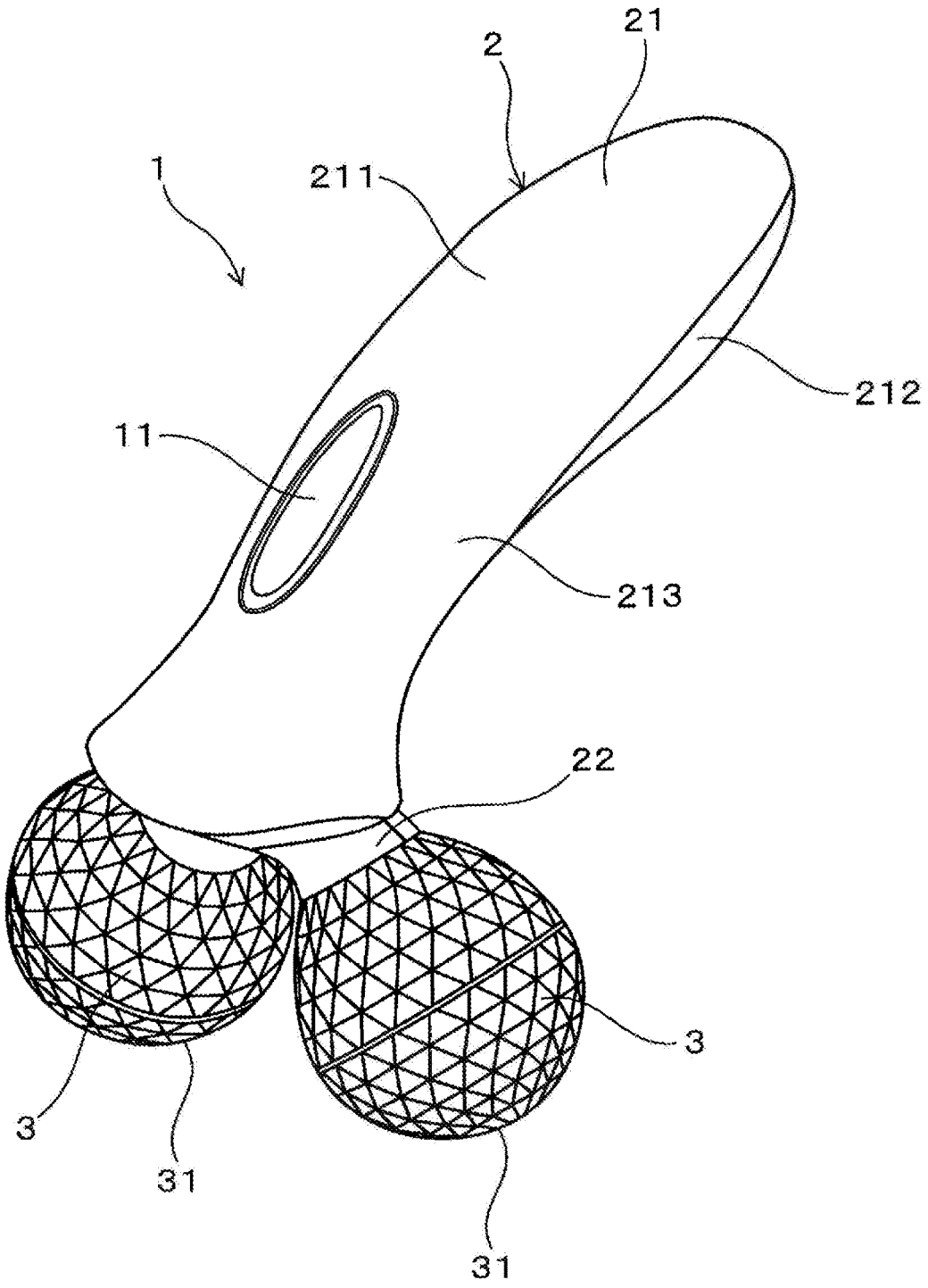
FIG. 1 is a perspective view of a beauty device according to a first embodiment of the present invention.

In the beauty device, the rotation axes of the two rollers may be arranged such that the distance between the rotation axes increases as the distance from the main body increases. More specifically, the rotation axes of the two rollers may be arranged to define a spreading shape toward the tips. In this case, when the beauty device is moved to reciprocate, the skin is kneaded as if to be picked up by the two rollers and a massage effect as a result of picking up the skin is provided.

The rotation axes of the two rollers may be arranged closer to each other in a further position from the main body. In this case, when the beauty device is moved to reciprocate, the skin is kneaded as if to be pressed and spread by the two rollers both in the forward path and the return path.

The rotation axes of the two rollers may be arranged on a common plane. In this case, when the beauty device is moved to reciprocate, the arm portion is allowed to pivot more easily. This improves the user-friendliness of the beauty device.

Also in the case, the handle portion is preferably inclined with respect to the plane. In this case, a desired massage effect is more easily achieved by the spontaneous operation of moving the beauty device back and forth so that the handle portion is positioned along the skin. Therefore, the user-friendliness of the beauty device is further improved.

The two rollers are rotationally held by the arm portion. Then, as described above, the two rollers pivot relative to the main body as the arm portion pivots. The arm portion may be configured to let the two rollers pivot synchronously or independently from each other. More specifically, for example in the former configuration, the two rollers may be connected through the arm portion. For example in the latter configuration, an arm portion which holds one roller and an arm portion which holds the other roller may be separated.

A pivot mechanism which allows the arm portion to pivot relative to the main body may be interposed between the arm portion and the main body. In this case, the arm portion pivots relative to the body about a pivot axis in a position on the main body or in a position between the main body and the arm portion. Therefore, the two rollers are allowed to pivot more easily during the reciprocation of the beauty device. As a result, the user-friendliness of the beauty device is further improved.

The pivot axis of the arm portion is preferably parallel to an imaginary straight line formed by connecting the centers of gravity of the two rollers. In this case, the two rollers are allowed to pivot more easily during the reciprocation of the beauty device. As a result, the user-friendliness of the beauty device is further improved.

The beauty device may have a roller holder provided with an arm portion, a pivot mechanism, and an urging mechanism. In this case, in the process of assembling the beauty device, the roller holder may be assembled first, and the roller holder may be accommodated in the main body, so that the workability in the operation of assembling the beauty device is further improved.

The pivot mechanism may include a lock switch exposed to the outside of the handle portion to switch between the off state in which the pivot movement is allowed and the on state in which the pivot movement is not allowed, an engaging portion which operates synchronously with the operation of the lock switch, and an engagement portion to be coupled with the two rollers, so that the engaging portion and the engagement portion are engaged with each other in the on state. When the lock switch is in the off state, the arm portion and the two rollers held by the arm portion are allowed to pivot as the beauty device is used. In this way, force to be applied on the skin from the two rollers can be adjusted to an appropriate level, and the comfortability in use of the beauty device is further improved.

When the lock switch is in the on state, the engaging portion and the engagement portion are engaged, so that the pivot movement of the arm portion is restricted. Since the pivot movement of the arm portion is restricted, the two rollers are pressed against the skin with larger force, and therefore the skin is kneaded with larger force. As a result, the massage effect by the rollers is increased.

As described above, the lock switch is operated to switch whether the arm portion is pivotal or not, which allows the device to be operated selectively in two modes, i.e., a mode particularly for the comfortability in use of the beauty device and a mode particularly for an enhanced massage effect. Therefore, the user-friendliness of the beauty device is further improved.

In the conventional configuration disclosed in Patent Document 2, the rotation locking portion presses the rotation portion against the bearing arm in order to fix the rotation movement of the rotation portion, and therefore as the spherical bodies are pressed against the skin surface during use, the position for locking the rotation of the rotation portion is easily shifted. Therefore, it is difficult to keep the rotation portion fixed in a desired position, and a desired massage effect may not be easily obtained. In contrast, when the lock switch, the engaging portion, and the engagement portion are provided, the engaging portion and the engagement portion are engaged with each other to restrict the pivot movement of the arm portion, and therefore the restriction position is hardly shifted even by pressing the rollers against the skin surface. Therefore, a desired massage effect is obtained even when the arm portion is restricted from pivoting.

The engaging portion may be configured to be engageable with the engagement portion while the arm portion is provided in the reference position. In this case, switching between the on state and the off state of the lock switch is more easily carried out. Therefore, the user-friendliness of the beauty device is more improved.

The engaging portion preferably has an insertion piece having a tapered surface and inserted into the engagement portion. In this case, when the insertion piece is inserted into the engagement portion, the tapered surface is brought into abutment against the engagement portion, so that backlash between the engaging portion and the engagement portion in the on state is reduced. As a result, backlash in the two rollers in the on state is reduced, and the comfortability in use of the beauty device is further improved.

A beauty device according to another aspect of the present invention includes a main body that can be held by the user and a roller provided rotationally around a rotation axis on the main body, and a locus described by the roller rotating around the rotation axis has a diameter reduced portion having a diameter inwardly reduced from opposite ends in the rotation axis direction.

In the beauty device according to the aspect, the locus described by the roller rotating around the rotation axis has a diameter reduced portion having a diameter inwardly reduced from the opposite ends in the rotation axis direction, so that the diameter reduced portion more easily conforms to the skin surface of gently bulging curved portions of the face. As a result, since the roller is easily fitted to the skin surface, the massage effect is enhanced and the feel in use is improved.

As described above, the beauty device according to the aspect provides an enhanced massage effect and improved feel in use.

The peripheral surface of the diameter reduced portion preferably has an arcuate shape as viewed in the direction orthogonal to the rotation axis. In this case, the diameter reduced portion more easily conforms to the skin surface of gently bulging curved portions of the face. Therefore, the roller is more easily fitted to the skin surface, and the massage effect and the feel in use is more improved.

The diameter reduced portion preferably has a minimum diameter in the center position in the rotation axis direction as viewed in the direction orthogonal to the rotation axis. In this case, the diameter reduced portion more easily conforms to a curved skin surface such as a face. Therefore, the roller is more easily fitted to the skin surface, and the massage effect and the feel in use is even more improved.

Protrusions which extend along the rotation axis direction and protrude radially outward are arranged side by side in the circumferential direction, at the outer peripheral surface of the roller, and at least a portion of the tops of the protrusions preferably draw the diameter reduced portion in the locus. In this case, the roller is moved and rotated along the skin surface, so that the protrusions can repeatedly press or pat the skin surface while the roller is fitted along the skin surface. This further enhances the massage effect.

The protrusions preferably include a first protrusion having a top approaching the rotation axis from a first end in the rotation axis direction toward a second end opposite to the first end and a second protrusion having a top approaching the rotation axis from the second end toward the first end. As a result, the skin surface is pressed or patted inwardly from the opposite sides in the rotation axis direction while the roller is kept fitted to the skin surface, and the massage effect is further enhanced.

The first and second protrusions are preferably alternately arranged in the circumferential direction. In this case, since the pressing or patting by the first protrusion and the pressing or patting by the second protrusion are alternately carried out, the massage effect is more enhanced.

Embodiments

First Embodiment

A beauty device according to an embodiment of the invention will be described with reference to the drawings. As shown in FIGS. 1 to 11, a beauty device 1 according to the embodiment includes a main body 2 including a handle portion 21 to be held by a user, an arm portion 6 (see FIG. 7) provided to be pivotal relative to the main body 2, two rollers 3 rotationally held by the arm portion 6, and an urging mechanism 42 (see FIG. 7) that urges the arm portion 6 toward a reference position within a range of the pivot movement.

Figure 6A:
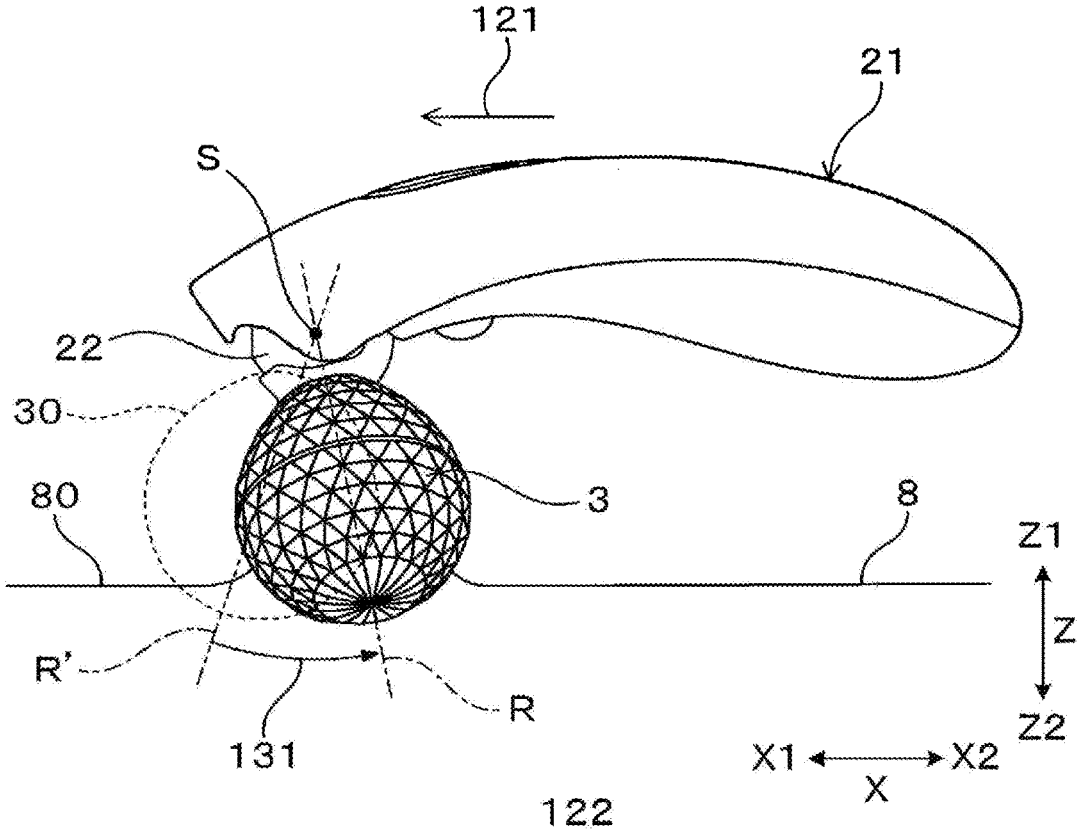
FIG. 6A is a side view of the beauty device according to the first embodiment during forward movement.
Figure 6B:
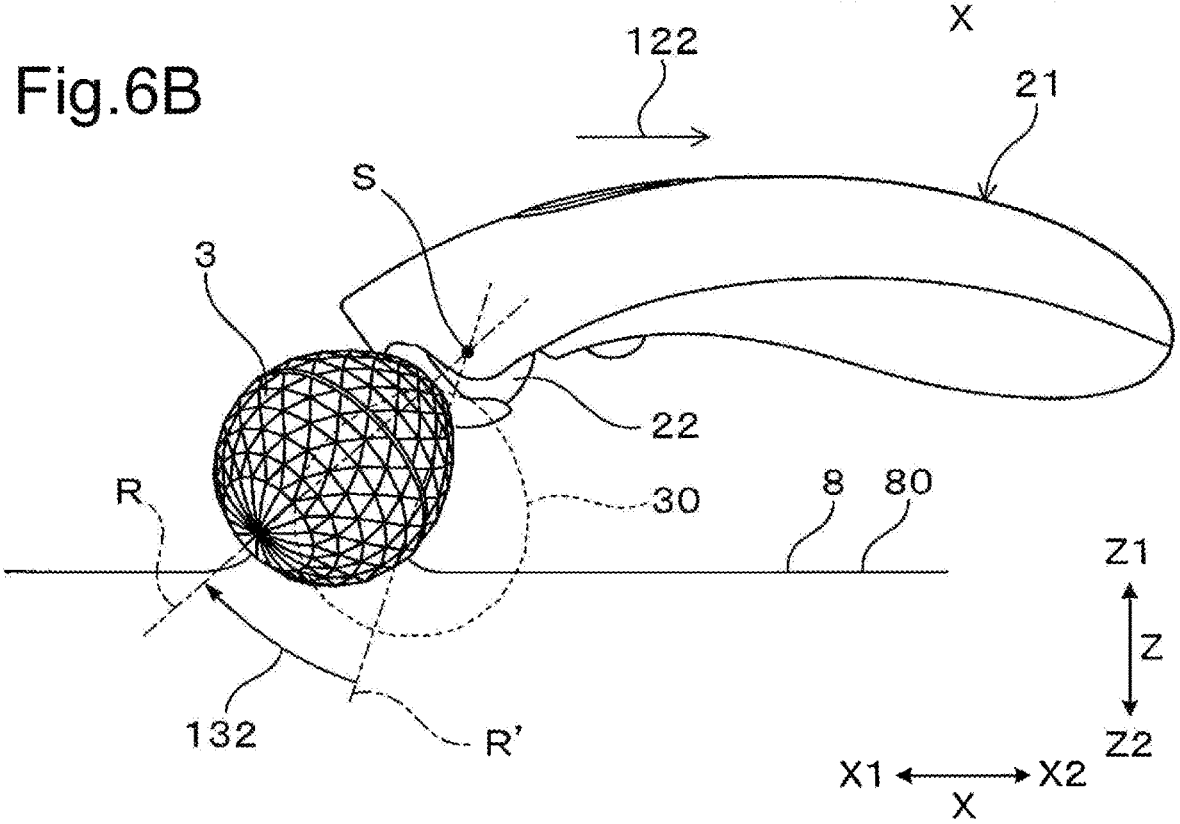
FIG. 6B is a side view of the beauty device according to the first embodiment during backward movement.
Figure 7:
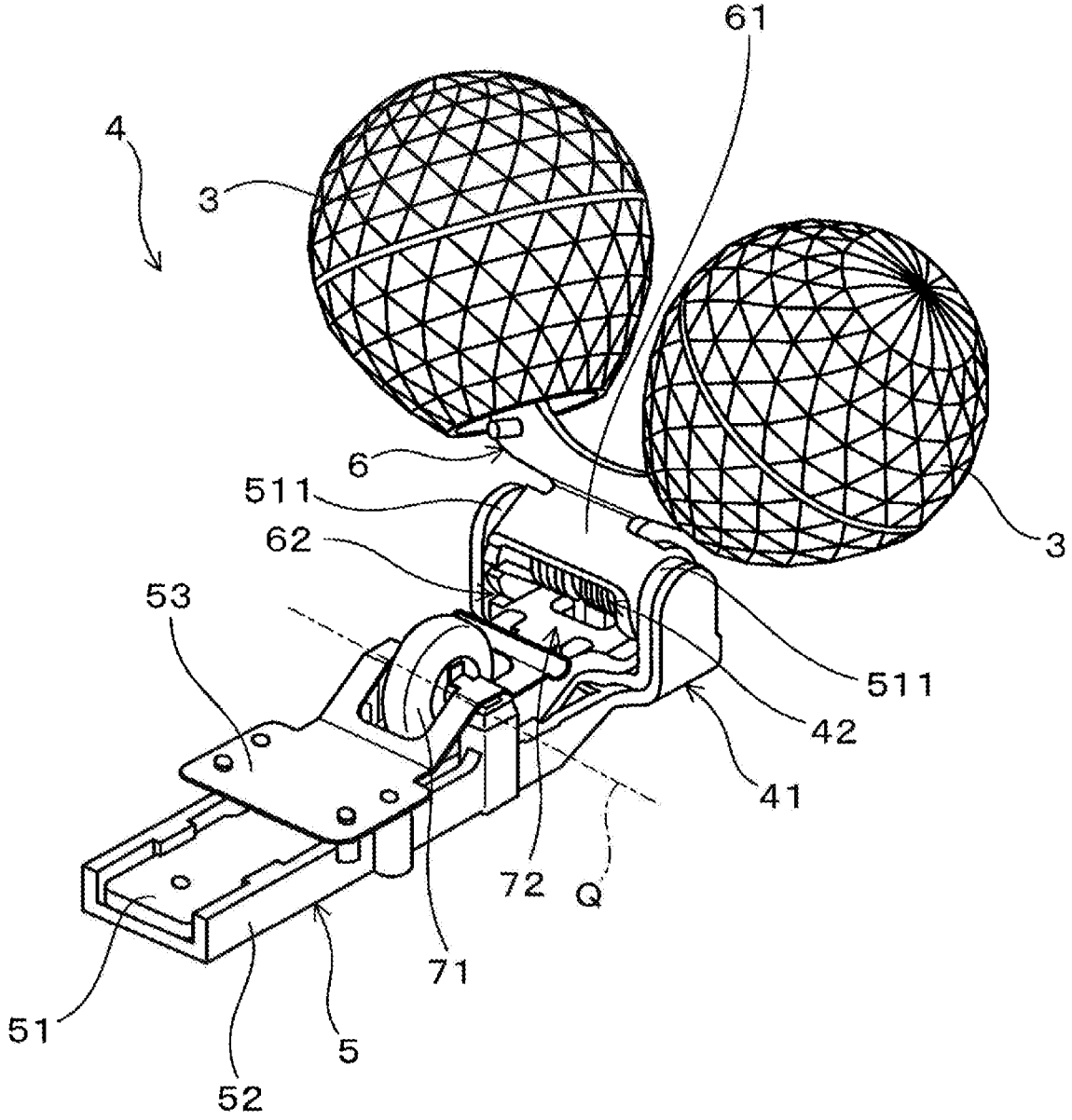
FIG. 7 is a perspective view of a roller holder according to the first embodiment.

As shown in FIGS. 6A, 6B, and 7, the beauty device 1 according to the embodiment further includes a pivot mechanism 41 interposed between the main body 2 and the arm portion 6 to allow the arm portion 6 to pivot relative to the main body 2. In the beauty device 1, the pivot mechanism 41 allows the arm portion 6 and the two rollers 3 held by the arm portion 6 to pivot relative to the main body 2 around a pivot axis S on the main body 2. Also in the beauty device 1, the urging mechanism 42 urges the arm portion 6 and the two rollers 3 moved from the reference position by the pivot movement toward the reference position.

As shown in FIG. 1, the main body 2 of the beauty device 1 has the handle portion 21 in a substantially rod shape and a branch portion 22 provided at one end in the longitudinal direction. The branch portion 22 is divided into two in a spreading manner toward the tip, and the rollers 3 are provided at the tips of the branch portion 22. As shown in FIGS. 6A and 6B, the branch portion 22 can pivot relative to the main body 2 around the pivot axis S synchronously with the pivot movement of the arm portion 6 and the roller 3.

Figure 2:
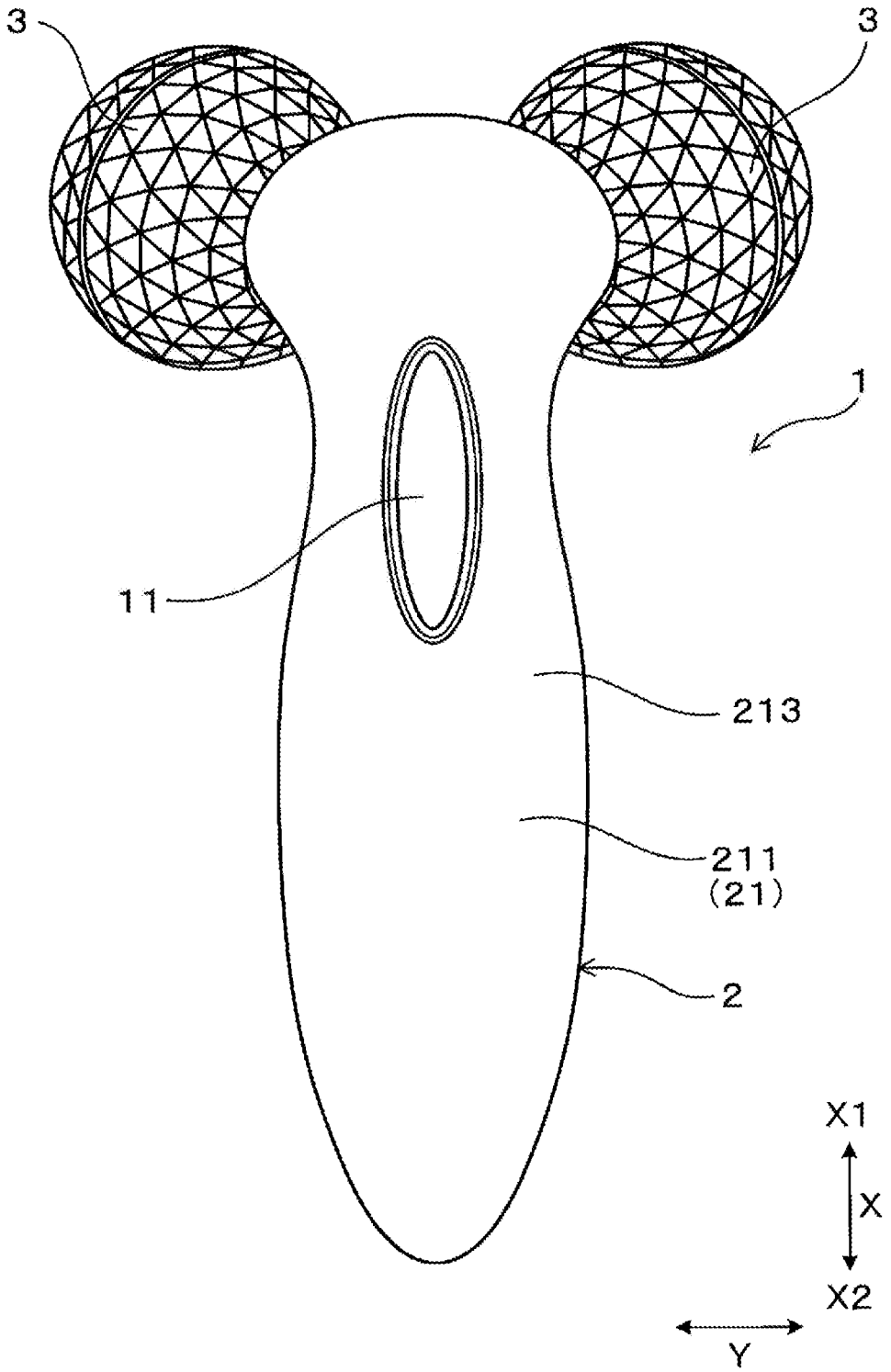
FIG. 2 is a plan view of the beauty device according to the first embodiment.
Figure 5:
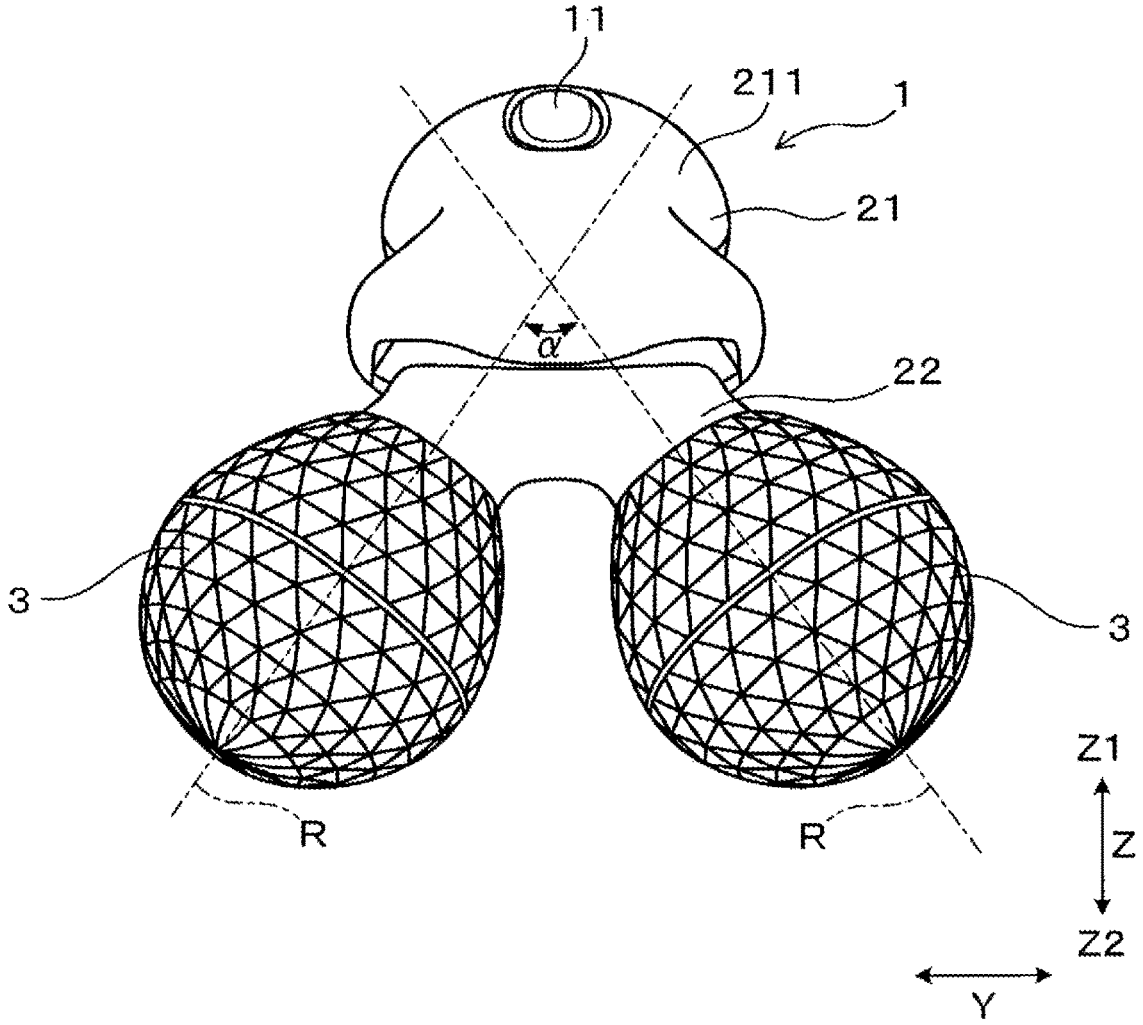
FIG. 5 is a front view of the beauty device according to the first embodiment.

As shown in FIGS. 2 and 5, the two rollers 3 are arranged apart in a direction orthogonal to the longitudinal direction of the main body 2. The rotation axes R of the two rollers 3 are arranged in a spreading manner such that the distance between the rotation axes R increases as the distance from the main body 2 increases. Also as shown in FIG. 3, the rotation axes R of the two rollers 3 are arranged on a common plane P, and the main body 2 is inclined with respect to the plane P.

In the following description, a direction parallel to the longitudinal direction of the main body 2 may be referred to as a "front-back direction X", the side on which the roller 3 is provided in the front-back direction X may be referred to as a "front side X1", and the opposite side thereto may be referred to as a "back side X2". The direction in which the two rollers 3 are arranged may be referred to as a "width direction Y". A direction orthogonal to both the front-back direction X and the width direction Y may be referred to as a "vertical direction Z", and in the vertical direction Z, the side on which the main body 2 is provided may be referred to as an "upper side Z1", and the side on which the roller 3 is provided may be referred to as a "lower side Z2". The indication about these directions is for ease of illustration and is irrelevant to directions for actually using the beauty device 1.

Figure 3:
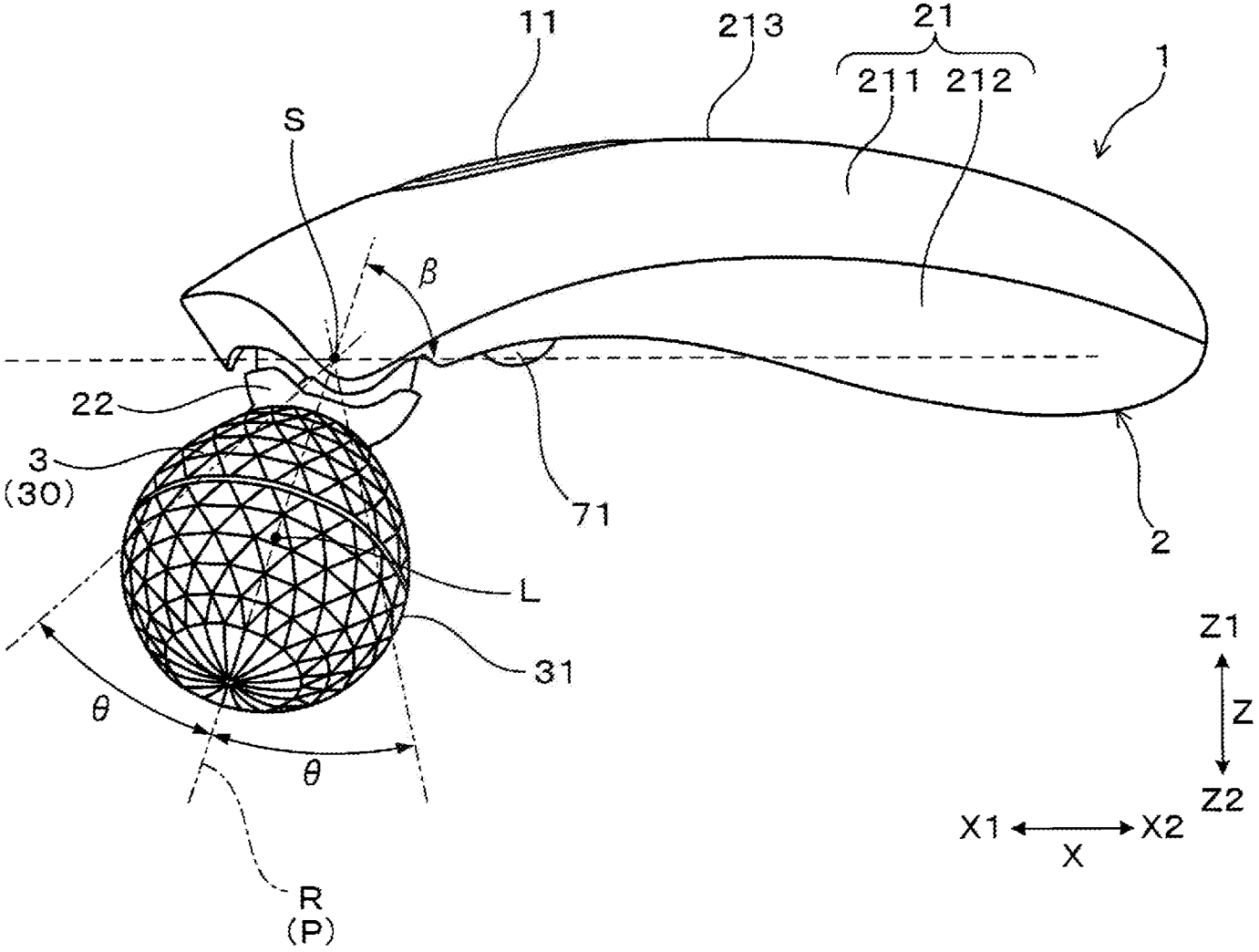
FIG. 3 is a side view of the beauty device according to the first embodiment.

As shown in FIG. 3, the pivot axis S of the arm portion 6 is arranged on the end of the main body 2 on the front side X1 and extends in the width direction Y. The pivot axis S extends in a direction parallel to an imaginary straight line L formed by connecting the centers of gravity of the two rollers 3.

The reference position of the arm portion 6 according to the embodiment is in the center in the entire range of pivot movement. The arm portion 6 can pivot up to 30° from the reference position to the front side X1 or the back side X2. In this way, as shown in FIGS. 3 and 6, the two rollers 3 can pivot up to 30° to the front side X1 or the back side X2 from the reference position 30 or the position where the arm portion 6 is in the reference position (see the symbol θ in FIG. 3). The maximum pivot angle θ of the arm portion 6 can be set as appropriate within the range from 20° to 45° when the reference position is 0°. From the viewpoint of the comfortability in use of the beauty device 1, the maximum pivot angle θ is preferably set within the range from 25° to 35°.

Various portions of the beauty device 1 will be described in more detail.

Figure 4:
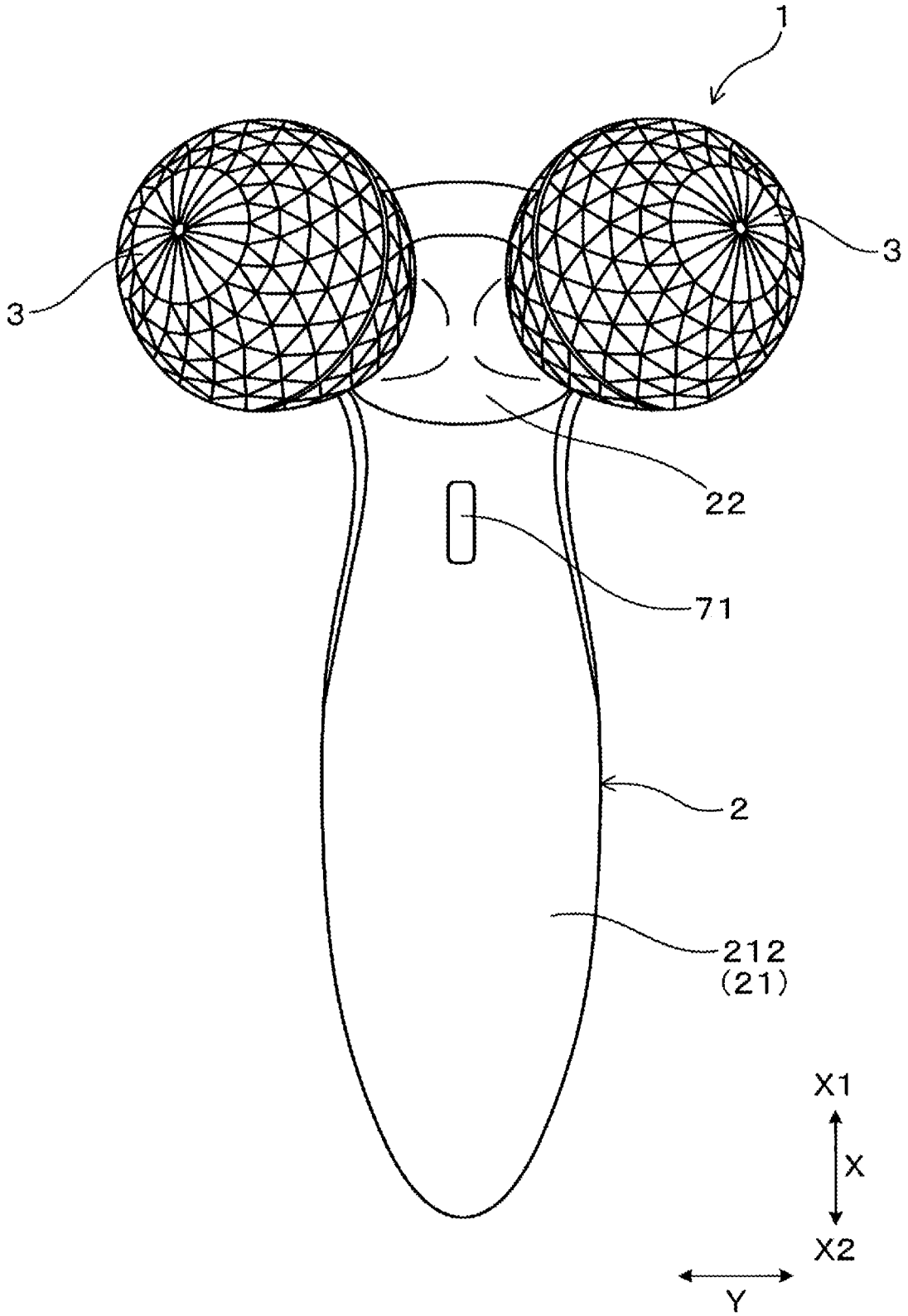
FIG. 4 is a bottom view of the beauty device according to the first embodiment.

As shown in FIG. 1, the main body 2 has a handle upper portion 211 which corresponds to the upper half of the handle portion 21 and a handle lower portion 212 which corresponds to the lower half of the handle portion 21. A solar cell unit 11 (which will be described later) is provided in the center of the handle upper portion 211 in the front-back direction X. As shown in FIG. 4, the handle lower portion 212 is provided with a lock switch 71 (which will be described later).

The roller holder 4 shown in FIG. 7 is stored in the main body 2. The roller holder 4 includes the arm portion 6, the pivot mechanism 41, and the urging mechanism 42 and holds the two rollers 3 in the rotational manner. The pivot mechanism 41 has a base portion 5 fixed to the main body 2 and a pivot shaft 43 (see FIGS. 9 and 10) that connects the base portion 5 and the arm portion 6 in a pivotal manner.

Figure 9:
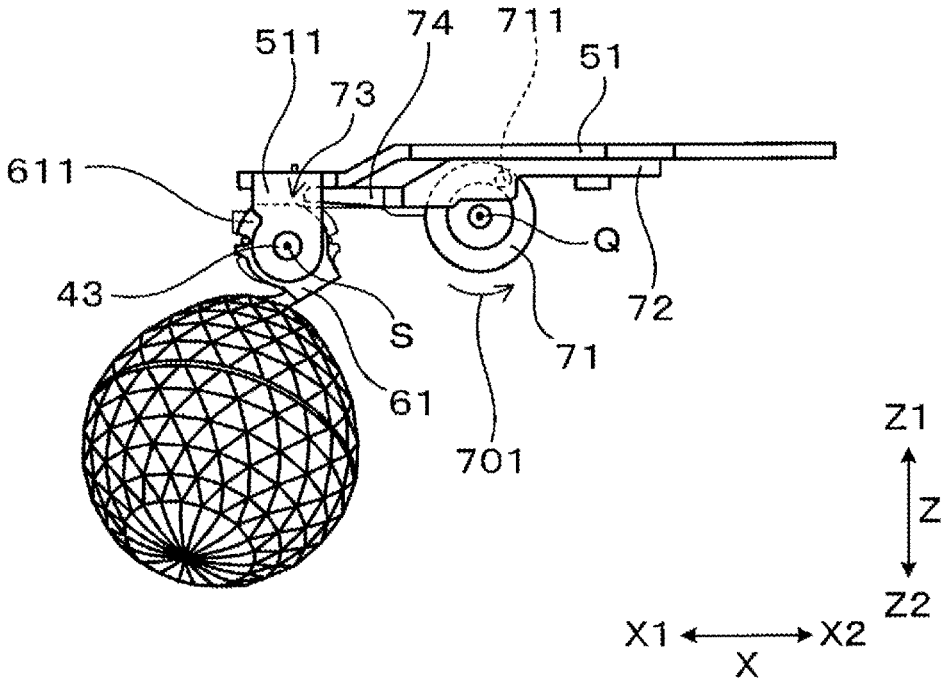
FIG. 9 is a side view of the essential portion of the roller holder according to the first embodiment.
Figure 10:
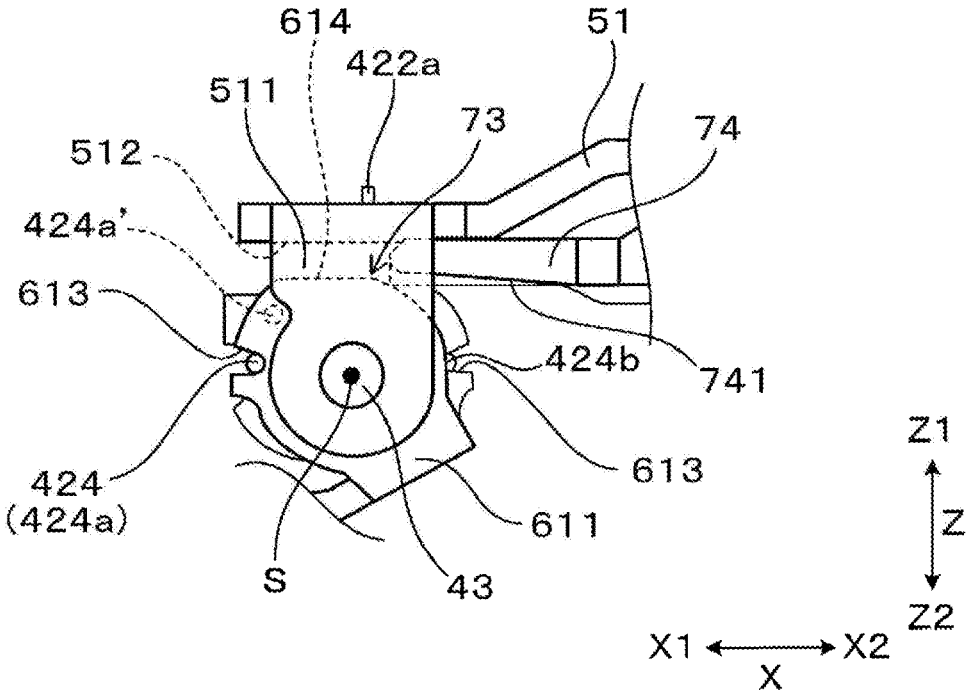
FIG. 10 is an enlarged view of the vicinity of a pivot shaft in FIG. 9.
Figure 11:
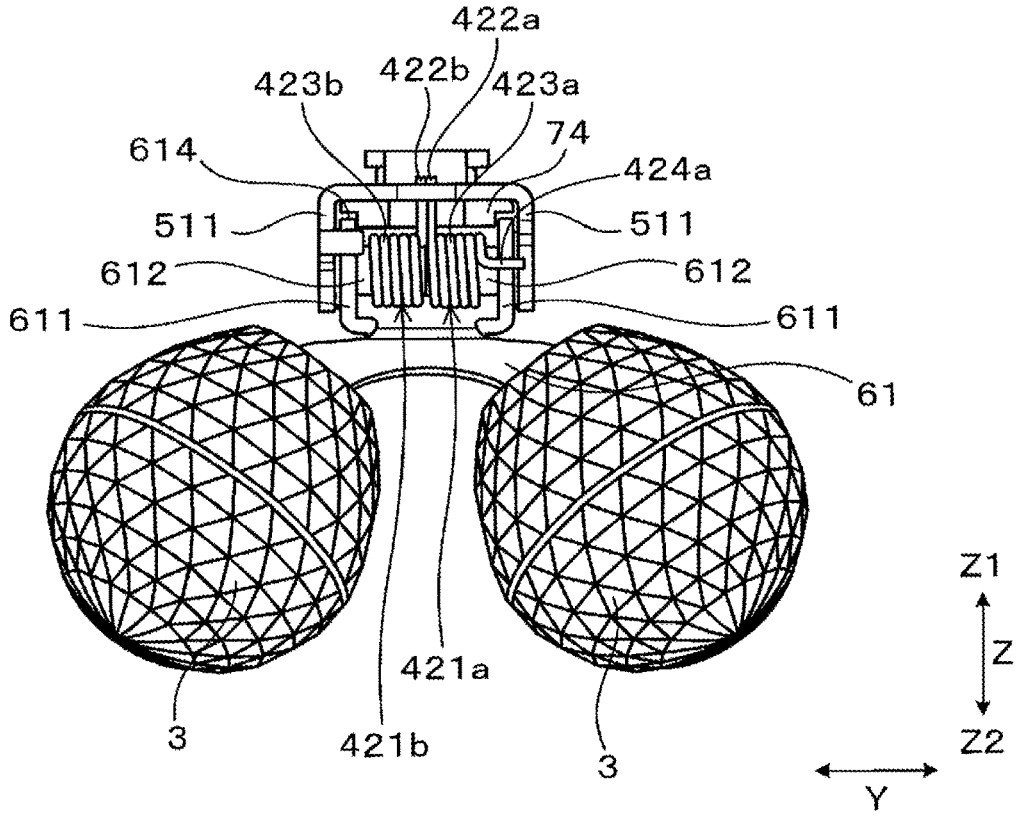
FIG. 11 is a front view of the roller holder according to the first embodiment.

As shown in FIG. 7, the base portion 5 has a flat base plate 51 made of a metal plate and extending in the front-back direction X, a cover 52 made of resin and covering the upper and side surfaces of the base plate 51, and a pressor plate 53 covering the lower surface of the plate 51. As shown in FIGS. 9 to 11, a pair of shaft receiving portions 511 is provided upright at the end of the base plate 51 on the front side X1. As shown in FIG. 10, the contour of the shaft receiving portion 511 has a substantially U shape as viewed in the width direction Y. The pivot shaft 43 is inserted in the center of the shaft receiving portion 511.

The arm portion 6 has an arm plate 61 made of a metal plate (see FIG. 11) which holds the rollers 3 in a rotational manner. A pair of tab portions 611 is provided upright at the end of the arm plate 61 on the back side X2. As shown in FIG. 11, the pair of tab portions 611 is provided on the inner side of the pair of shaft receiving portions 511 in the base portion 5 and slide into contact with the shaft receiving portions 511 through a bushing 612.

As shown in FIGS. 9 and 10, the tab portion 611 has a substantially circular shape as viewed in the width direction Y. As shown in FIG. 10, a spring fixing groove 613, which fixes an end 424 (which will be described later) of a torsion spring 421, and a flat surface 614 are provided on the outer peripheral edge of the tab portion 611. The flat surface 614 is arranged parallel to the surface 512 of the base plate 51 when the arm portion 6 is in the reference position. The insertion piece 74 (which will be described later) of the engaging portion 72 is inserted between the flat surface 614 and the base plate 51. The pivot shaft 43 is inserted in the center of the tab portion 611.

As shown in FIG. 9, the pivot shaft 43 is provided on the pivot axis S of the arm portion 6. The opposite ends of the pivot shaft 43 are rotationally held by the cover 52 of the base portion 5 (not shown). The pivot shaft 43 is inserted into both the shaft receiving portion 511 and the tab portion 611. In this way, the base portion 5 and the arm portion 6 are connected in a pivotal manner through the pivot shaft 43.

As shown in FIG. 11, the urging mechanism 42 according to the embodiment has two torsion springs 421 (421*a*, 421*b*). The two torsion springs 421 are arranged side by side in the width direction Y between the pair of tab portions 611. Each of the torsion springs 421 has one end 422 (422*a*, 422*b*) protruding to the upper side Z1 in the center in the width direction Y, a coil portion 423 (423*a*, 423*b*) wound clockwise from the end 422 as a starting point, and the other end 424 (424*a*, 424*b*) extending outward from the end of the coil portion 423 in the width direction Y.

One end 422 of each of the torsion springs 421 is inserted into a spring fixing hole (not shown) of the base plate 51. The other end 424 is inserted into the spring fixing groove 613 of the tab portion 611 facing each of the torsion springs 421 as shown in FIG. 10. The pivot shaft 43 shown in FIG. 10 and the bushing 612 shown in FIG. 11 are provided on the inner side of the coil portion 423 of each of the torsion springs 421.

When the arm portion 6 is in the reference position, the two torsion springs 421 are in a natural state. When the arm portion 6 is in the reference position, the urging force of the first torsion spring 421*a* may be balanced with the urging force of the second torsion spring 421*b*. When the arm portion 6 pivots away from the reference position, the position of the end 424 of each of the torsion springs 421 inserted into the spring fixing groove 613 is turned around the pivot axis S relative to the end 422 inserted in the base plate 51.

More specifically, when the arm portion 6 pivots toward the front side X1, the position of the end 424 inserted in the spring fixing groove 613 is turned so that the coil portion 423*a* of the first torsion spring 421*a* is rewound and the coil portion 423*b* of the second torsion spring 421*b* is enwound. When the arm portion 6 pivots to the back side X2, the position of the end 424 inserted in the spring fixing groove 613 is turned so that the coil portion 423*a* of the first torsion spring 421*a* is enwound, and the coil portion 423*b* of the second torsion spring 421*b* is rewound.

Then, when the arm portion 6 pivots either toward the front side X1 or back side X2, the coil portion 423 enwound or rewound as described above provides urging force in the direction opposite to the pivot direction. As a result, the urging force in the direction to let the arm portion 6 regain the reference position is applied to the arm portion 6.

The end 424 inserted in the spring fixing groove 613 is provided to abut against the shaft receiving portion 511 while the arm portion 6 is the furthest from the reference position. When the arm portion 6 has pivoted 30° to the front side X1 from the reference position, the end 424*a* of one torsion spring 421*a* of the two torsion springs 421 abuts against the shaft receiving portion 511 (FIG. 10, see the reference character 424*a*'). Although not shown, when the arm portion 6 pivots 30° to the back side X2 from the reference position, the end 424*b* of the other torsion spring 421*b* abuts against the shaft receiving portion 511. In this way, the pivot range of the arm portion 6 is restricted not to exceed 30° in either of the directions toward the front side X1 and the back side X2 from the reference position.

The pivot mechanism 41 according to the embodiment further includes the lock switch 71 exposed to the outside of the main body 2 to switch between an off state, which allows the arm portion 6 to pivot, and an on state, which does not allow the arm portion 6 to pivot (see FIGS. 3, 4, 8, and 9), the engaging portion 72, which operates synchronously with the operation of the lock switch 71 (see FIGS. 8 and 9), and an engagement portion 73 connected to the two rollers 3 (see FIGS. 9 and 10). As shown in FIG. 7, the engaging portion 72 and the engagement portion 73 are configured to be engaged with each other in the on state.

Figure 8:
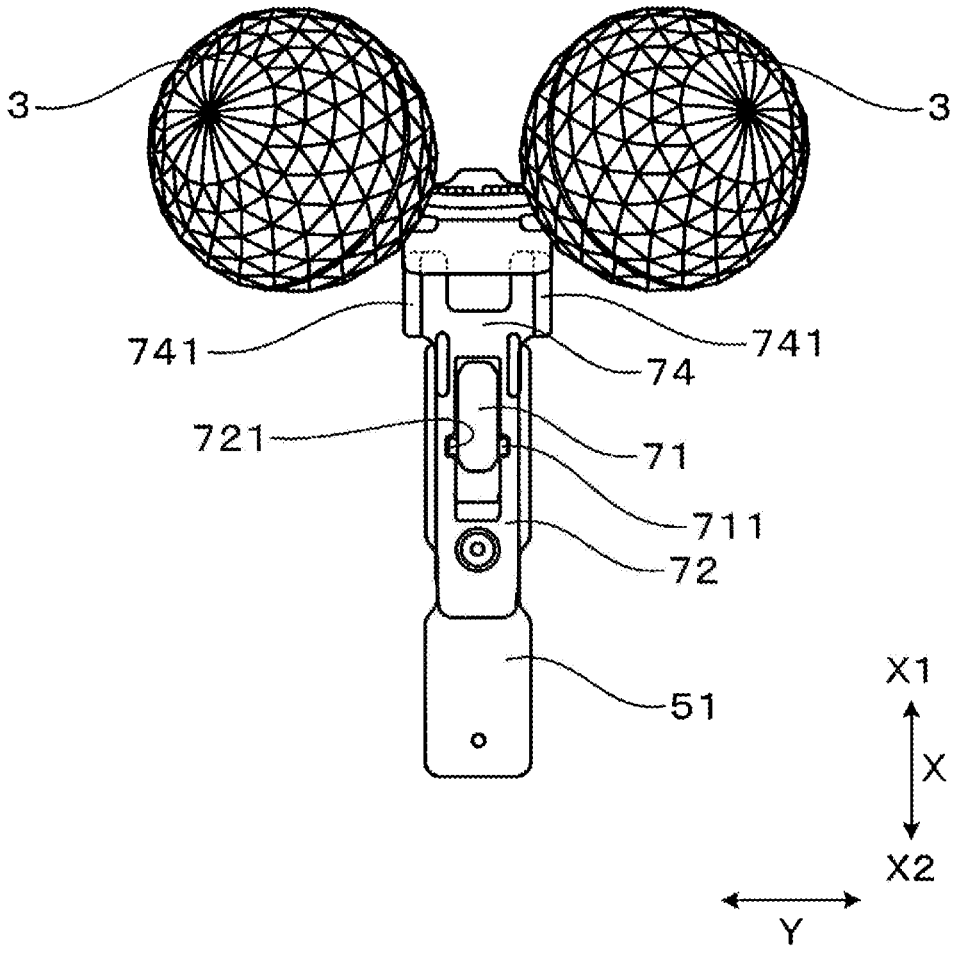
FIG. 8 is a bottom view of an essential portion of the roller holder according to the first embodiment.

As shown in FIGS. 8 and 9, the lock switch 71 has a wheel shape. The lock switch 71 is held by the base portion 5 so that the switch 71 can rotate around a rotation axis Q, which extends in the width direction Y (see FIG. 7). As shown in FIG. 8, a pair of pins 711 protrudes from the side surface of the lock switch 71. The pins 711 are stored in pin receiving grooves 721 (which will be described later) provided in the engaging portion 72.

As shown in FIGS. 8 and 9, the engaging portion 72 has a substantially rod shape extending in the front-back direction X and is provided between the base plate 51 and the rotation axis Q of the lock switch 71. The insertion piece 74 having a tapered surface 741 and inserted into the engagement portion 73 is provided at the end of the engaging portion 72 on the front side X1. As shown in FIG. 8, the insertion piece 74 has a substantially flat plate shape and has tapered surfaces 741 at opposite ends in the width direction Y. The pin receiving grooves 721, which receive the pins 711 of the lock switch 71, are provided on the back side X2 behind the insertion piece 74.

The beauty device 1 according to the embodiment can switch between the on state and the off state as follows. When the lock switch 71 is switched from the off state to the on state, the lock switch 71 is rotated to the back side X2 (see arrow 701 in FIG. 9). The rotation causes the pair of pins 711 to move to the front side X1, and the engaging portion 72 slides to the front side X1 synchronously with the movement of the pins 711. In order to switch the lock switch 71 from the on state to the off state, the lock switch 71 simply needs to be rotated to the front side X1.

When the arm portion 6 is in the reference position, a gap is formed between the surface 512 of the base plate 51 and the flat surface 614 of the tab portion 611 (see FIG. 10). The insertion piece 74, which slides to the front side X1 as the lock switch 71 rotates, is inserted into the gap. Then, the tapered surface 741 and the flat surface 614 of the tab portion 611 abut against each other, so that the arm portion 6 and the rollers 3 are restricted from pivoting. As described above, according to the present embodiment, the base plate 51 and the pair of tab portions 611 of the roller holder 4 are configured to also function as the engagement portion 73.

Although not shown, in the beauty device 1 according to the embodiment, when the arm portion 6 is in a position shifted from the reference position, the gap between the surface 512 of the base plate 51 and the tab portion 611 is narrower than the thickness of the tapered surface 741. Therefore, when the arm portion 6 is in a position shifted from the reference position, the insertion piece 74 cannot be inserted into the engagement portion 73, and the state cannot be switched from the off state to the on state.

The operation and advantages of the beauty device 1 according to the embodiment will be described. In the beauty device 1 according to the embodiment, the arm portion 6 and the two rollers 3 held by the arm portion 6 can be pivoted relative to the main body 2 around the pivot axis S positioned on the main body 2. The arm portion 6 and the two rollers 3 moved from the reference position by the pivot movement are urged toward the reference position. In this way, the beauty device 1 efficiently provides a desired massage effect simply by pressing the two rollers 3 against the skin and moving the rollers to reciprocate without greatly changing the position of the handle portion 21 with respect to the skin in any of advancing directions including the forward path and the return path.

More specifically, as shown in FIG. 6A, when the beauty device 1 is advanced in the forward path (denoted by the arrow 121), the arm portion 6 and the two rollers 3 pivot to the back side X2 behind the reference position 30 against the urging force of the urging mechanism 42 (denoted by the arrow 131). In this way, the rotation axis R of each of the rollers 3 can be inclined toward the back side X2 relative to the rotation axis R' in the reference position 30.

The two rollers 3 are spontaneously returned to the reference position 30 by the urging force of the urging mechanism 42 by moving the beauty device backward upon completing the movement in the forward path and turning back in the return path. As shown in FIG. 6B, the beauty device is moved backward from the state (denoted by the arrow 122), so that the two rollers 3 are turned to the front side X1 beyond the reference position 30 (denoted by the arrow 132) and are inclined toward the front side X1 relative to the rotation axis R' in the reference position 30.

When turning back from the return path to the forward path, the two rollers 3 spontaneously pivot to the back side X2 behind the reference position 30 as the beauty device 1 advances, so that the rotation axis R is inclined toward the back side X2 relative to the rotation axis R' in the reference position 30.

As described above, when the beauty device 1 is used in the simplest manner in which the position of the handle portion 21 with respect to the skin 8 is approximately kept constant while the beauty device 1 reciprocates, the rotation axis R can be easily inclined in the same direction with respect to the skin 80 on the leading side of the rollers 3 in the traveling direction in either of the forward path and the return path. As a result, a desired massage effect is easily and efficiently provided in either of the forward path and the return path.

As shown in FIGS. 2 and 5, the two rollers 3 are arranged such that the distance between their rotation axes R increases as the distance from the main body 2 increases. Therefore, as shown in FIGS. 6A and 6B, when the beauty device 1 is moved to reciprocate, the two rollers 3 can knead the skin 8 as if to pick up the skin both in the forward and return paths, and a massage effect by picking up the skin 8 is provided.

As shown in FIG. 3, the rotation axes R of the two rollers 3 are arranged on a common plane P, and the main body 2 is inclined with respect to the plane P. Therefore, a desired massage effect is more easily achieved by spontaneous operation such as the reciprocation of the beauty device 1 so that the main body 2 is moved along the skin 8, and the user-friendliness of the beauty device 1 is further improved.

As shown in FIG. 3, the pivot axis S of the arm portion 6 is parallel to an imaginary straight line L formed by connecting the centers of gravity of the two rollers 3. Therefore, the two rollers 3 can more easily pivot in the reciprocation of the beauty device 1. As a result, the user-friendliness of the beauty device 1 is further improved.

As shown in FIG. 7, the beauty device 1 has the roller holder 4 provided with the arm portion 6, the pivot mechanism 41, and the urging mechanism 42. Therefore, in the operation of assembling the beauty device 1, the workability in assembling the beauty device 1 is further improved by assembling the roller holder 4 first and then storing the roller holder 4 in the main body 2.

As shown in FIG. 9, the pivot mechanism 41 includes the lock switch 71 exposed to the outside of the handle portion 21 to switch between the off state in which the roller 3 is allowed to pivot and the on state in which the roller is not allowed to pivot, an engaging portion 72 which operates synchronously with the operation of the lock switch 71, and an engagement portion 73 connected to the arm portion 6. The engaging portion 72 and the engagement portion 73 are configured to be engaged in the on state. Therefore, the lock switch 71 can switch whether the two rollers 3 are pivotal or not, so that two modes, i.e., a mode particularly for the comfortability in use of the beauty device 1 and a mode particularly for an enhanced massage effect can be selectively used. Therefore, the user-friendliness of the beauty device 1 is further improved.

The engagement portion 73 is configured to be engageable with the engaging portion 72 when the two rollers 3 are in the reference position. Therefore, switching between the on state and the off state of the lock switch 71 can be performed more easily, and the user-friendliness of the beauty device 1 is further improved.

The engaging portion 72 has an insertion piece 74 having a tapered surface 741 and inserted into the engagement portion 73. Therefore, when the insertion piece 74 is inserted into the engagement portion 73, the tapered surface 741 is abutted against the engagement portion 73, so that any backlash between the engaging portion 72 and the engagement portion 73 in the on state is reduced. As a result, backlash between the two rollers 3 in the on state is reduced, and the comfortability in use of the beauty device 1 is further improved.

As shown in FIGS. 1 and 3, the beauty device 1 according to the embodiment is configured so that weak current can be supplied through a current path including the solar cell unit 11 exposed on the handle upper portion 211, a handle electrode 213 provided at the surface of the main body 2, a roller electrode 31 provided on the surface of the roller 3, and the skin 8.

Specifically, the handle electrode 213 according to the embodiment is provided on the outer surface of the handle upper portion 211. The handle electrode 213 is electrically connected to the positive electrode of the solar cell unit 11 inside the main body 2 by a wire which is not shown. The handle electrode 213 according to the embodiment is a chromium plated film having conductivity.

The roller electrode 31 is electrically connected to the negative electrode of the solar cell unit 11 through a conductor (not shown) inside the roller 3, the arm portion 6 in the roller holder 4, the torsion spring 421, the base portion 5, and an electric wire, which is not shown, in the mentioned order. The arm portion 6 and the torsion spring 421 are electrically connected at the abutment portion between the tab portion 611 and the end 424 inserted in the spring fixing groove 613. The torsion spring 421 and the base portion 5 are electrically connected at the abutment portion between the end 422 inserted into the base portion 5 and the spring fixing hole of the base portion 5. The roller electrode 31 according to the embodiment is a chromium plated film having conductivity.

The beauty device 1 according to the embodiment provides a beauty effect such as blood flow promotion and metabolism stimulation as weak current is passed through the skin 8. These effects and the massage effect by the rollers 3 act together to add a synergistic effect, so that a higher beauty effect is provided.

Second Embodiment

According to the embodiment, the engaging portion 72 and the engagement portion 73 have different configurations. Among the reference numerals used in the present and subsequent embodiments, the same reference numerals as those used in the previous embodiments indicate the same elements and the like as those in the previous embodiments unless otherwise specified.

Figure 12:
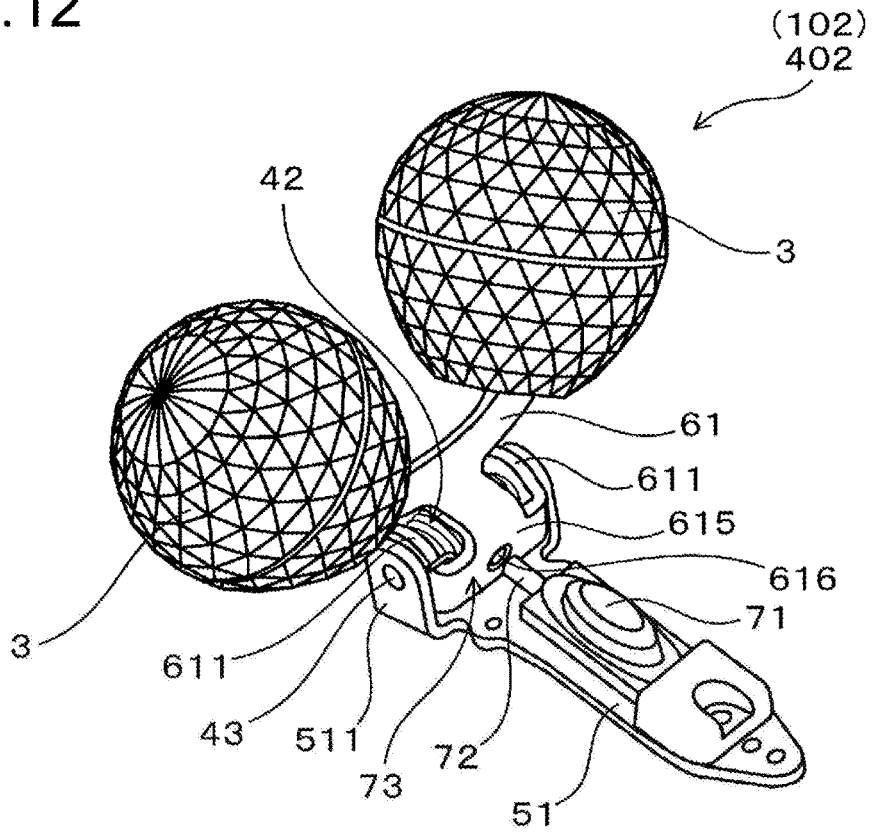
FIG. 12 is a perspective view of an essential portion of a roller holder according to a second embodiment of the present invention.

As shown in FIG. 12, the roller holder 402 according to the embodiment has a lock switch 71 that slides in the front-back direction X. A rod-like engaging portion 72, which extends in the front-back direction X, is attached to the lock switch 71.

The engagement portion 73 is provided at a connection portion 615 of an arm plate 61 that connects a pair of tab portions 611. The connection portion 615 is provided to face the engaging portion 72 when the arm portion 6 is in the reference position. In the center of the connection portion 615, a through hole 616, into which the tip end of the engaging portion 72 is inserted, is provided.

In the beauty device 102 according to the embodiment, the tip end of the engaging portion 72 can be inserted into the through hole 616 of the connection portion 615 by sliding the lock switch 71 to the front side X1 when the arm portion 6 is in the reference position. In this way, the engaging portion 72 and the engagement portion 73 are engaged with each other, and the arm portion 6 and the rollers 3 are restricted from pivoting. The embodiment is otherwise the same as the first embodiment. The beauty device 102 according to the embodiment provides the same operation and advantages as the first embodiment except for the operation and advantages of the tapered surface 741.

Third Embodiment

Figure 13:
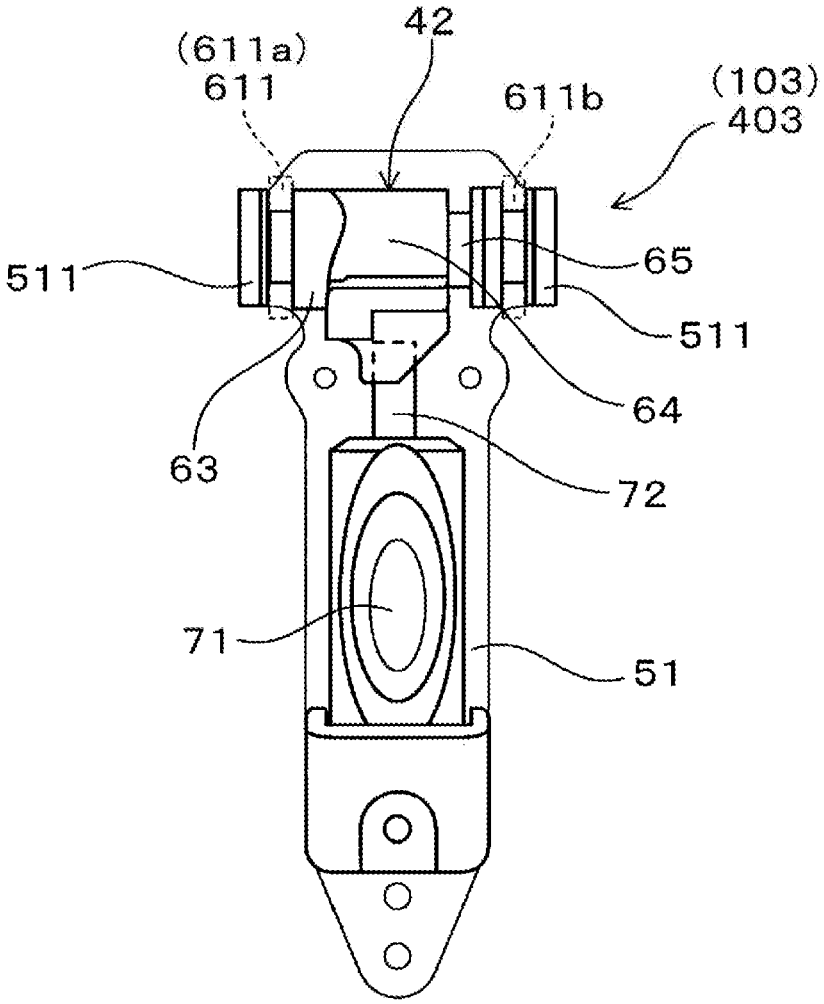
FIG. 13 is a bottom view of an essential portion of a roller holder according to a third embodiment of the present invention.

According to the embodiment, the urging mechanism 42 has a different configuration. As shown in FIG. 13, the urging mechanism 42 according to the embodiment has an end face cam 63 that rotates synchronously with one tab portion 611*a* of the pair of tab portions 611 (611*a* and 611*b*), a driven portion 64 which reciprocates in the width direction Y as the end face cam 63 rotates, and a coil spring 65 interposed between the driven portion 64 and the other tab portion 611*b*. In FIG. 13, the arm portion 6 is omitted for the ease of illustration.

As shown in FIG. 13, when the arm portion 6 is in the reference position, the entire surface of the end face cam 63 is in abutment against the driven portion 64. The coil spring 65 is compressed more than its natural length when the arm portion 6 is in the reference position. Therefore, the driven portion 64 is pressed against the end face cam 63.

The urging mechanism 42 in the beauty device 103 according to the embodiment operates as follows. When the arm portion 6 pivots relative to the main body 2 and moves away from the reference position, the end face cam 63 operates synchronously with the pivot movement of the arm portion 6 and rotates around the pivot axis S. The driven portion 64 is pushed toward the other tab portion 611*b* in the width direction Y as the end face cam 63 rotates.

The driven portion 64 pushed out toward the other tab portion 611 in the width direction Y is urged toward the end face cam 63 by the urging force of the coil spring 65. Since the urging force is transmitted to the arm portion 6 through the end face cam 63 and the arm plate 61, urging force in a direction to return to the reference position is applied to the arm portion 6 and the roller 3.

In the beauty device 103 according to the embodiment, when the state is switched from the off state to the on state, the lock switch 71 is slid to the front side X1. The engaging portion 72 slides toward the front side X1 synchronously with the lock switch 71 and has its tip end abutted against the surface of the driven portion 64 (not shown). Then, the movement of the arm portion 6 is restricted by the frictional force between the engaging portion 72 and the driven portion 64, and thus the roller 3 is restricted from pivoting. In this way, the beauty device 103 according to the embodiment is configured so that the driven portion 64 also functions as the engagement portion 73. The embodiment is otherwise the same as the second embodiment. The beauty device 103 according to the embodiment provides the same operation and advantages as those of the second embodiment.

The beauty device according to the present invention is not limited to those according to the first to third embodiments, and may be modified as appropriate without departing from the gist of the present invention. For example, according to the first to third embodiments, the two rollers 3 have rotation axes R arranged spreading toward the tips, while the rotation axes R of the two rollers 3 may be parallel to each other or approach each other to define a tapered shape.

According to the first to third embodiments, the beauty device 1 is configured to allow the two rollers to pivot synchronously by the arm portion 6 by way of illustration, while the rollers 3 may be configured to pivot independently from each other. In this case, an arm portion that holds one roller and an arm portion that holds the other roller may be separated from each other.

In addition to the members made of metal plates according to the first to third embodiments, a member such as a universal joint may be used for the arm portion 6. For example, when a universal joint is used for the arm portion, one end of the universal joint is held by the main body while the roller is attached to the other end, so that the roller can pivot relative to the main body.

While the rollers 3 according to the first to third embodiments have a spherical shape by way of illustration, the rollers 3 may have a cylindrical shape.

While the solar cell unit 11 is configured to generate weak current to flow through the skin 8 according to the first embodiment, any other known power source such as a battery may be used to generate the weak current instead of the solar cell unit 11.

The beauty devices 1, 102, and 103 according to the first to third embodiments each include two rollers 3 by way of illustration, while the number of rollers 3 may be increased. For example, when the number of rollers 3 is four, the rollers 3 may be provided below the main body 2. In this case, if at least two of the four rollers 3 can pivot relative to the main body 2 as described above, the operation and advantages by the beauty device according to the present invention can be provided. The remaining two rollers 3 may be pivotal or non-pivotal. The same applies if the number of rollers 3 is further increased.

Fourth Embodiment

A beauty device 104 according to the embodiment has a structure shown in FIGS. 14 to 19. The elements equivalent to those of the first to third embodiments are designated by the same reference characters and their description will not be provided. According to the embodiment, there is no mechanism for prohibiting the pivot movement of the arm portion 6 such as the lock switch 71 and the insertion piece 74 according to the first embodiment. Therefore, the arm portion 6 is kept in a constantly pivotal state.

Figure 14:
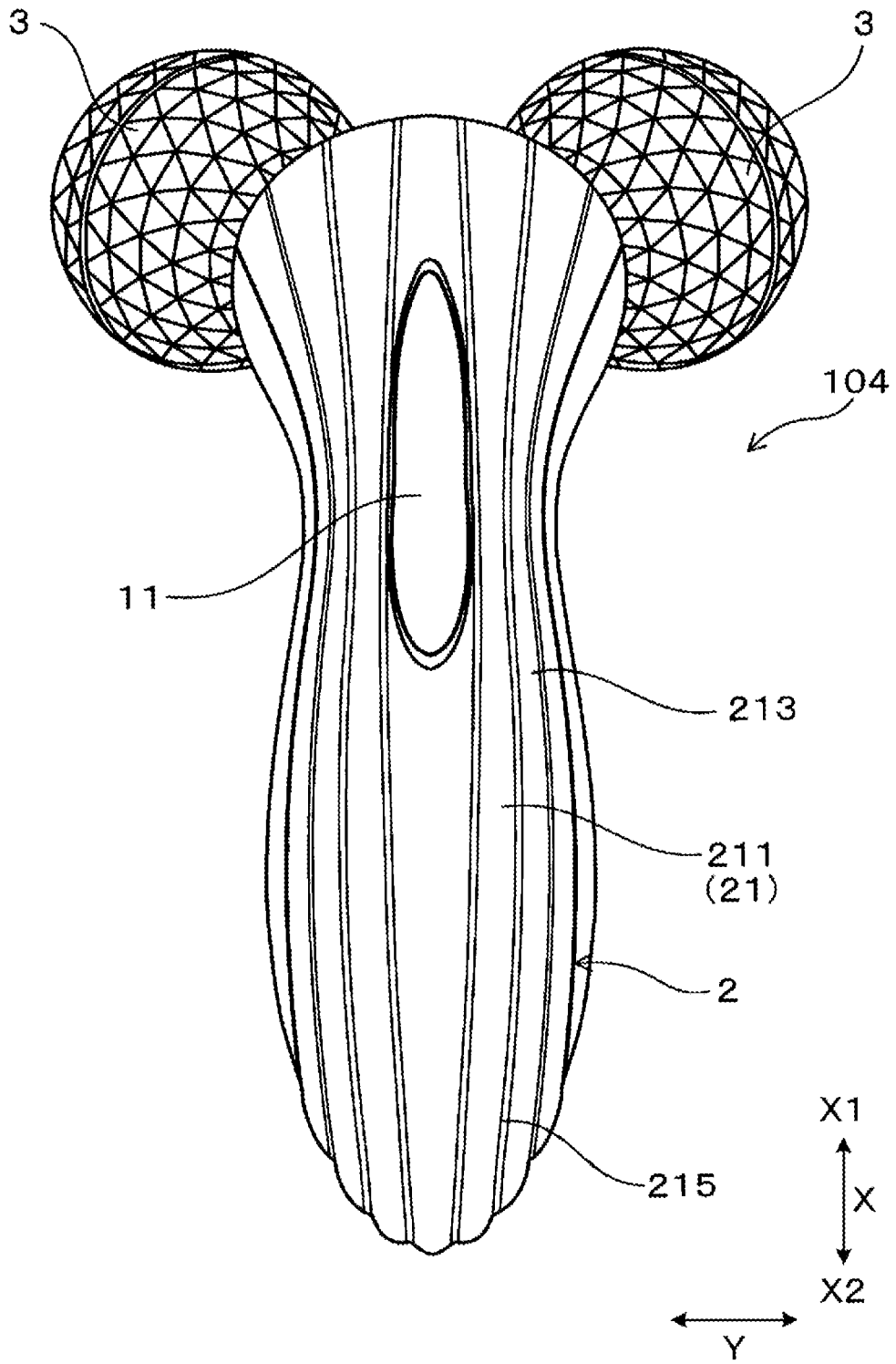
FIG. 14 is a plan view of a beauty device according to a fourth embodiment of the present invention.
Figure 15:
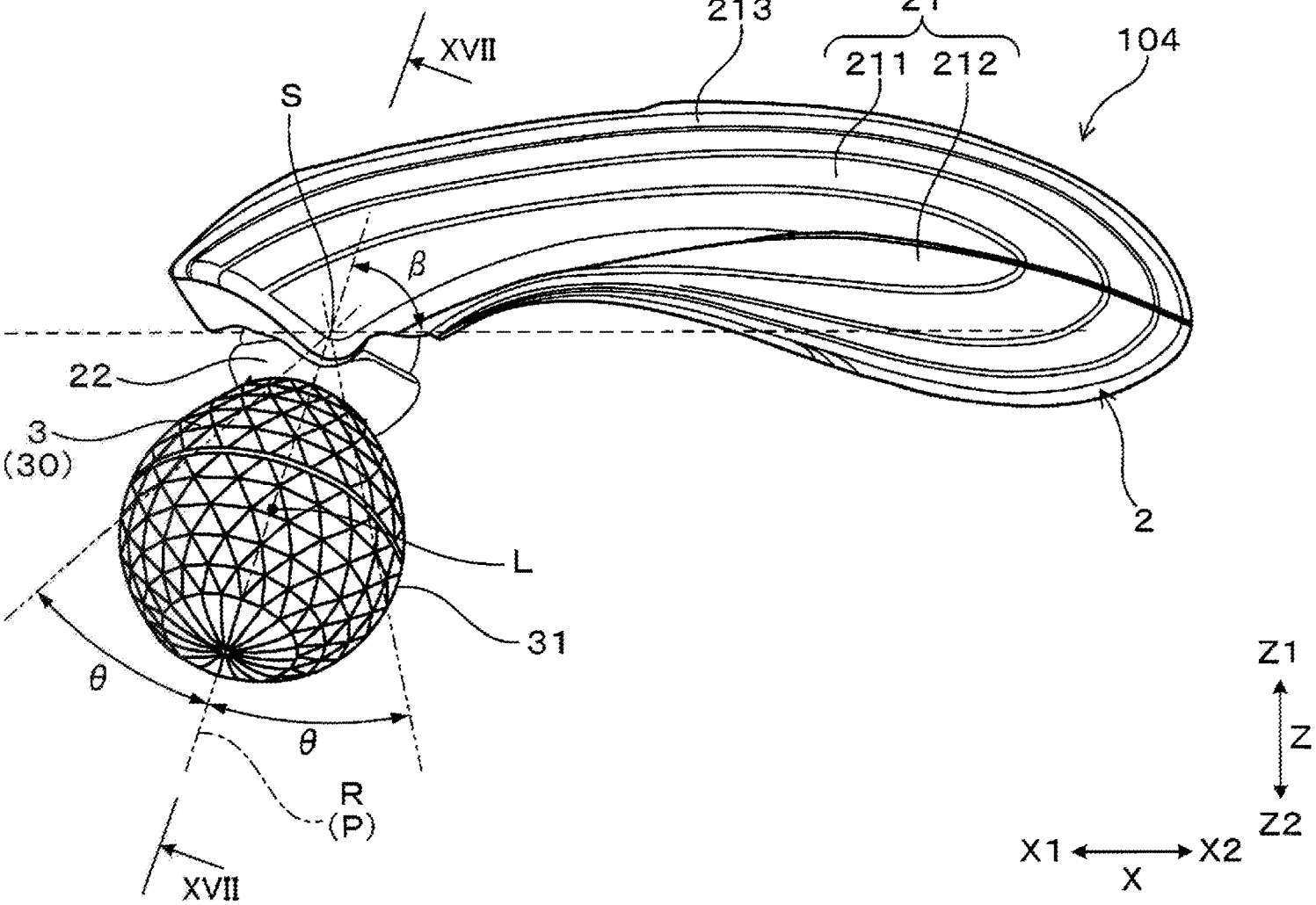
FIG. 15 is a side view of the beauty device according to the fourth embodiment.
Figure 16:
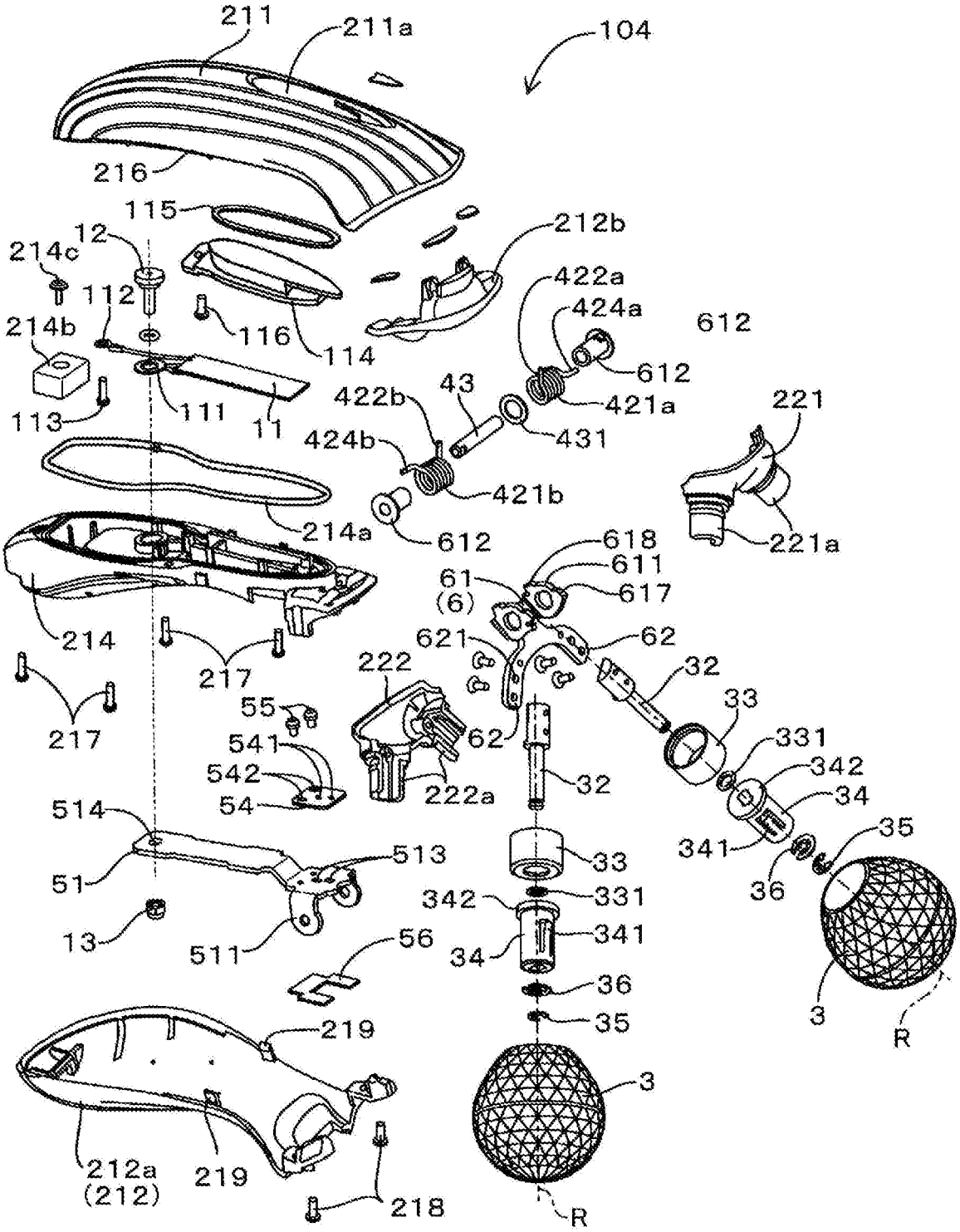
FIG. 16 is an exploded perspective view of the beauty device according to the fourth embodiment.

According to the embodiment, as shown in FIG. 15, the handle portion 21 of the main body 2 is graspable and includes a handle upper portion 211 and a handle lower portion 212. As shown in FIG. 14, the handle upper portion 211 has grooves 215, which extend in the front-back direction as viewed from the top. As shown in FIG. 16, an opening 211*a* is formed in the handle upper portion 211. A lens 114 is fitted in the opening 211*a* through a tape 115. The lens 114 is fixed to the handle upper portion 211 by a screw 116.

Figure 17:
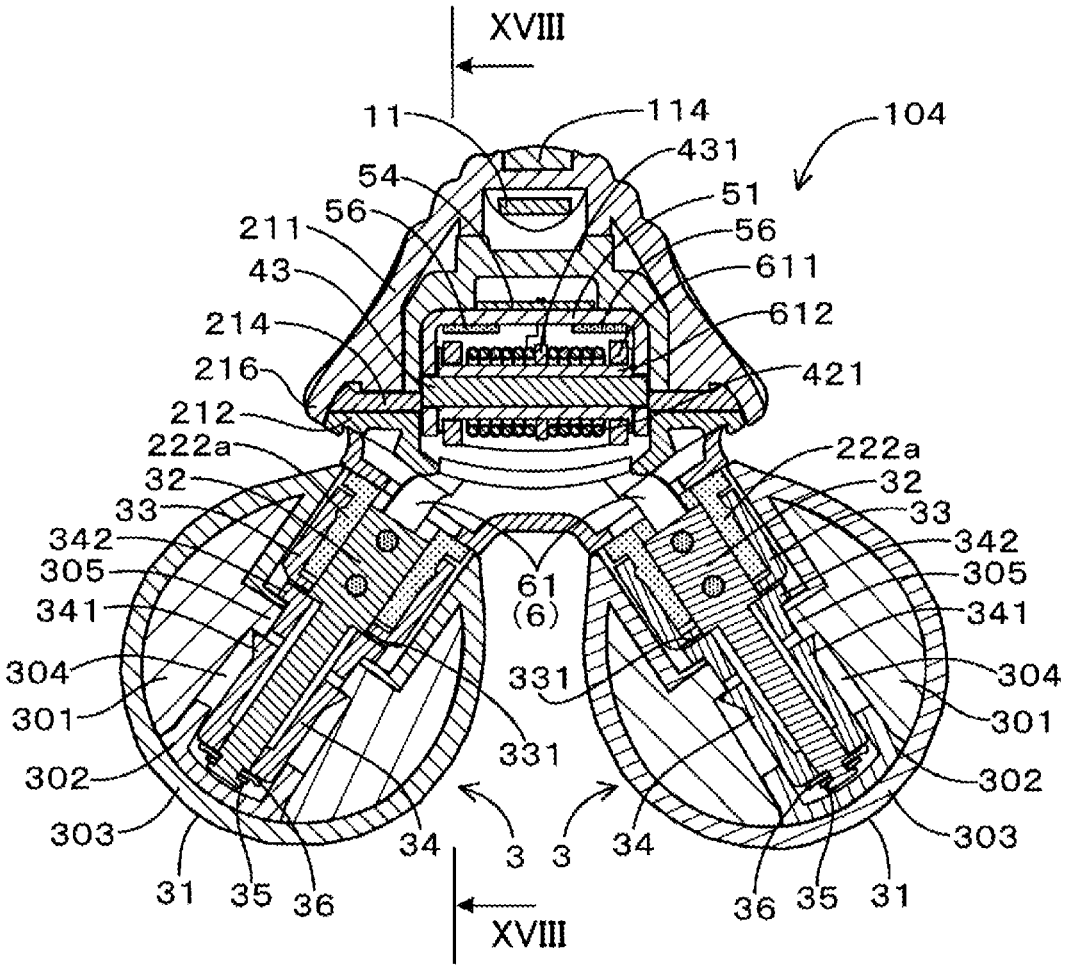
FIG. 17 is a cross-sectional view taken along line XVII-XVII in FIG. 15.

As shown in FIG. 16, a handle base 214 is attached by a screw 217 to the handle upper portion 211 on the lower surface side. A packing 214*a* is interposed between the handle upper portion 211 and the handle base 214. A weight 214*b* is attached to the handle base 214 by a screw 214*c*. The handle upper portion 211 and the handle lower portion 212 are fitted with each other through screws 218 and engagement claws 219 provided on the handle lower portion 212. As shown in FIG. 17, the outer edge 216 of the handle upper portion 211 covers the outer edge of the handle lower portion 212 and the outer edge of the handle base 214.

As shown in FIG. 16, according to the embodiment, a pair of fixing holes 513 through which one end 422 (422*a* or 422*b*) of each of the torsion springs 421 (421*a* or 421*b*) is inserted is elongated in the front-back direction X in the base plate 51. Each of the torsion springs 421 (421*a* and 421*b*) is inserted in the pivot shaft 43 through the bushing 612, and a washer 431 is also inserted between the torsion spring 421*a* and the torsion spring 421*b*. The washer 431 prevents the torsion spring 421*a* and the torsion spring 421*b* from contacting each other, which reduces a squeaking sound generated during the pivot movement of the arm portion 6.

An adjuster 54 is stacked on the base plate 51 to overlap the pair of fixing holes 513. The adjuster 54 has a pair of engagement holes 541 and a pair of attachment holes 542. The engagement holes 541 are positioned to overlap the fixing holes 513. The pair of the engagement holes 541 each have a substantially circular shape and a shorter length than that of the pair of the fixing holes 513 in the front-back direction X. The ends 422 of the torsion springs 421 inserted into the pair of fixing holes 513 are fitted in the pair of engagement holes 541.

In contrast, the pair of attachment holes 542 in the adjuster 54 is elongated in the front-back direction X similarly to the pair of fixing holes 513 provided in the base plate 51. The adjuster 54 is stacked and fixed on the base plate 51 by screws 55 inserted in the pair of attachment holes 542 and screwed to the base plate 51. Since the pair of attachment holes 542 is elongated in the front-back direction X, the attachment position for the adjuster 54 can be shifted relative to the base plate 51 in the front-back direction X.

Then, as described above, the fixing holes 513, into which the ends 422 of the torsion springs 421 engaged with the pair of engagement holes 541 are inserted, are also elongated in the front-back direction X, and therefore the position of the ends 422 of the torsion springs 421 in the front-back direction X can be changed and adjusted by changing the attachment position for the adjuster 54 in the front-back direction X. The reference position for the arm portion 6 can be adjusted by adjusting the position of the ends 422 of the torsion springs 421 in the front-back direction X.

Figure 19:
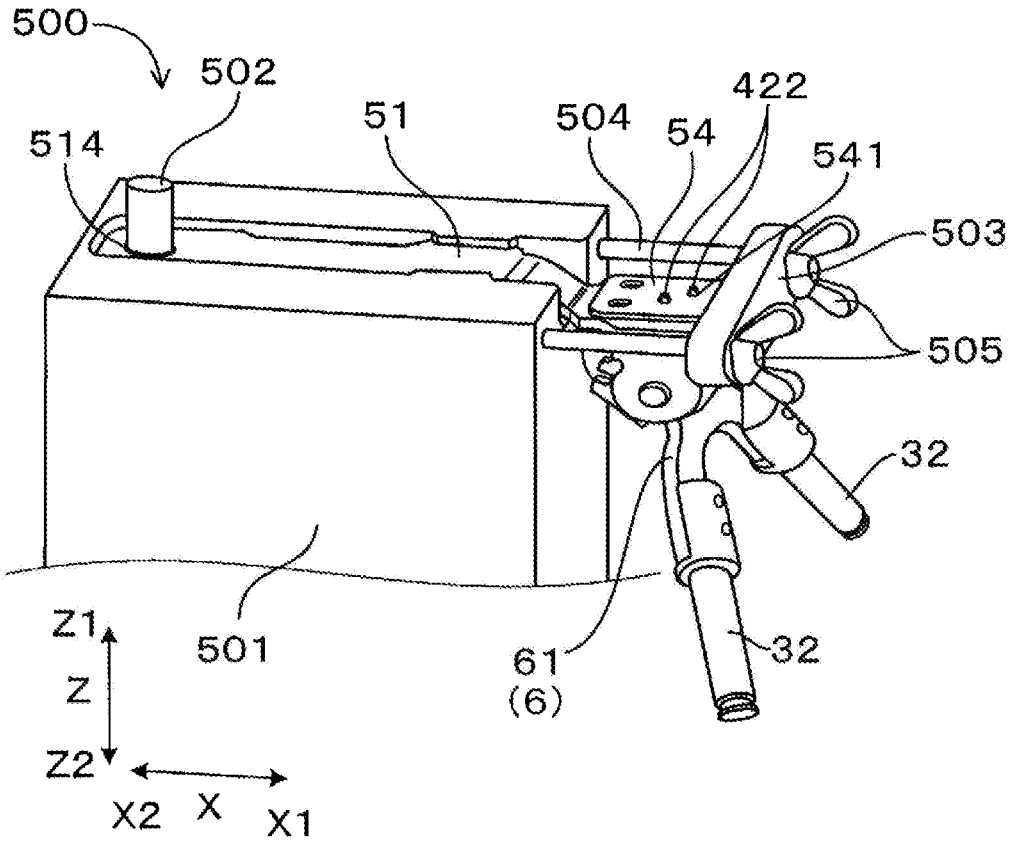
FIG. 19 is a diagram illustrating the concept of assembling process according to the fourth embodiment.

The reference position for the arm portion 6 can be adjusted as follows using an adjusting jig 500 shown in FIG. 19. To start with, the base plate 51 provided with the arm plate 61 thereon is prepared when the screw 55 is not yet attached. Then, the base plate 51 is set on the fixing stage 501 of the adjusting jig 500. At this time, a fixing projection 502 provided on the fixing stage 501 is inserted into the screw hole 514 of the base plate 51 to securely fix the base plate 51.

Then, a positioning member 503 is contacted to the front end surface of the adjuster 54. The positioning member 503 can change the position of the adjuster 54 by pressing the adjuster 54 to the back side X2. In the adjusting jig 500 according to the embodiment, the positioning member 503 is slidable in the front-back direction X through a pair of support rods 504. The positioning member 503 is slid to the back side X2 by tightening ribbed nuts 505 provided on the pair of support rods 504. The position (arm angle) of the arm portion 6 is slightly on the back side X2 behind the reference position, in other words, the adjuster 54 is slightly on the front side.

While the position (arm angle) of the arm portion 6 is detected using a prescribed sensor, the positioning member 503 is slid to the back side X2, and the adjuster 54 is pressed to the back side X2. Then, when the position (arm angle) of the arm portion 6 is a prescribed angle corresponding to the reference position, the screws 55 are fastened to fix the position of the adjuster 54. The ribbed nuts 505 are loosened, the base plate 51 is removed from the fixing stage 501, and the operation of adjusting the reference position of the arm portion 6 ends.

As shown in FIG. 16, a cushion 56 is provided on the side of the base plate 51 opposite to the side on which the adjuster 54 is attached. The cushion 56 is made of thermoplastic elastomer (TPE) and has a sheet shape. According to the embodiment, the cushion 56 is made of TPE with a hardness of 90 degrees and has a thickness of 0.7 mm.

Figure 18A:
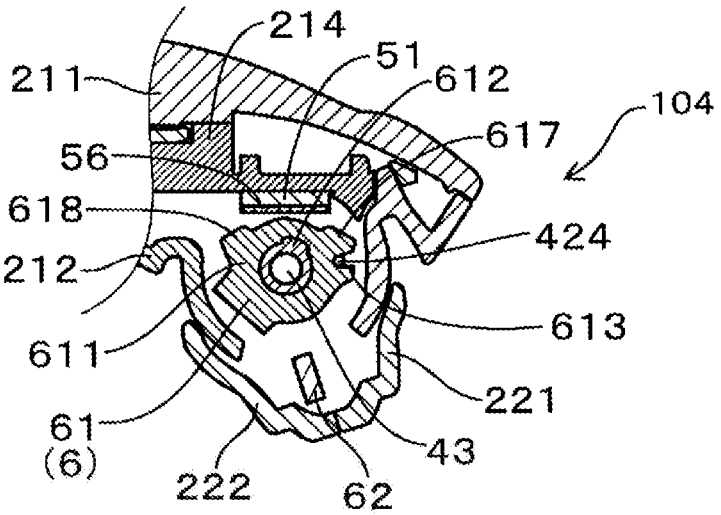
FIG. 18A is a cross-sectional view of the arm portion in a reference state according to the fourth embodiment.
Figure 18B:
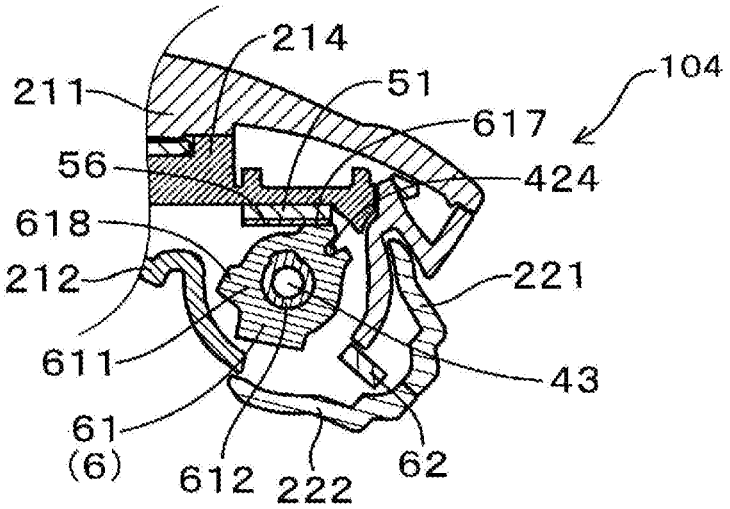
FIG. 18B is a cross-sectional view of the arm portion during backward movement according to the fourth embodiment.
Figure 18C:
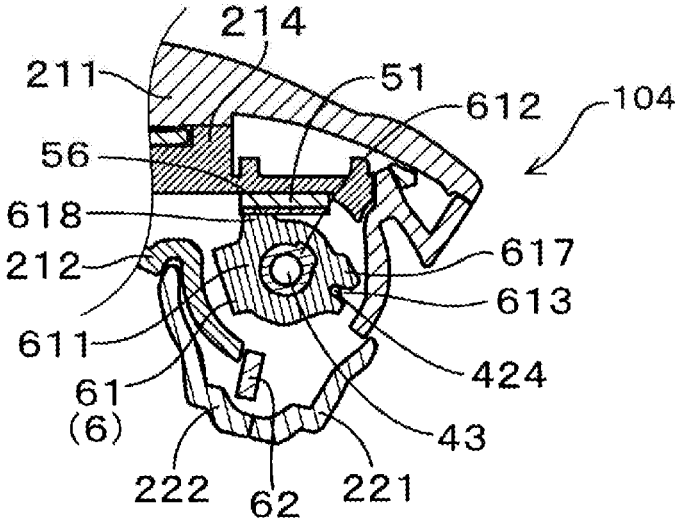
FIG. 18C is a cross-sectional view of the arm portion during forward movement according to the fourth embodiment.

As shown in FIGS. 16 and 18A to 18C, a front restricting portion 617 and a rear restricting portion 618 are provided on the outer edge of the pair of tab portions 611 of the arm portion 6. The front restricting portion 617 has a flat surface, and as shown in FIG. 18B, the front restricting portion 617 abuts against the base plate 51 through the cushion 56 when the arm portion 6 pivots a maximum pivot angle to the front side X1. In this way, the front restricting portion 617 restricts the arm portion 6 from pivoting forward at or beyond the maximum pivot angle. The rear restricting portion 618 also has a flat surface, and as shown in FIG. 18C, the rear restricting portion 618 abuts against the base plate 51 through the cushion 56 when the arm portion 6 pivots the maximum turning angle to the back side X2. As a result, the rear restricting portion 618 restricts the arm portion 6 from pivoting rearward at or beyond the maximum pivot angle. In this way, the pivotal range of the arm portion 6 is restricted by the front restricting portion 617 and the rear restricting portion 618. Since the front restricting portion 617 and the rear restricting portion 618 are in contact with the base plate 51 through the cushion 56, and therefore an impact noise upon contacting is suppressed, so that the noise is reduced.

As shown in FIG. 16, a pair of shaft attachment portions 62 is provided on the rotation axes R of the rollers 3 at the front end of the arm plate 61 in the arm portion 6. Roller shafts 32 extending in parallel with the rotation axes R are attached to the pair of shaft attachment portions 62. A front arm cover 221 and a rear arm cover 222 are attached to the arm plate 61. The front arm cover 221 and the rear arm cover 222 are provided with semi-cylindrical portions 221*a* and 222*a*, respectively and cover the pair of shaft attachment portions 62. A cylindrical cap 33 made of plastic is fitted in each of the semi-cylindrical portions 221*a* and 222*a*. The semi-cylindrical portions 221*a* and 222*a* are sealed by the caps 33, and electrical insulation between the front and rear arm covers 221 and 222 and the roller electrodes 31 is secured by the caps 33.

As shown in FIG. 16, a bearing 34 is attached to the roller shaft 32. The bearing 34 is made of plastic and has a cylindrical shape. As shown in FIG. 17, the roller shaft 32 is inserted through the inside of the bearing 34, and the bearing 34 is fixed and kept from coming off by a stop ring 35 attached to the tip of the roller shaft 32 through a bearing spacer 36. The entire outer surface of the bearing 34 including the front and back surfaces of the bearing 34 is plated with a metal to ensure that there is conduction between the bearing 34 and the roller shaft 32. Instead of metal plating, the conduction between these elements may be secured by forming the bearing 34 of a conductive resin. According to the embodiment, a ring-shaped polystyrene washer 331 is interposed between the bearing 34 and the cap 33.

As shown in FIGS. 16 and 17, engaging claws 341 are formed to protrude outward in the radial direction at the outer peripheral surface of the bearing 34. As shown in FIG. 17, the stepped portion 305 of the roller 3 which will be described later engages with the engaging claw 341. At the end of the bearing 34, a large diameter portion 342 having a diameter increased outward in the radial direction Y1. The stepped portion 305 is located between the engaging claw 341 and the large diameter portion 342. The stepped portion 305 abuts against the engaging claw 341 and the large diameter portion 342 and is held by these elements. As a result, the roller 3 is positioned with respect to the roller shaft 32, and the backlash about the roller 3 is reduced.

As shown in FIG. 17, the roller 3 is rotationally supported on the roller shaft 32 together with the bearing 34 through the bearing 34 provided on the roller shaft 32. The roller 3 includes a core member 301 made of plastic, a cap member 302 made of plastic and fitted in the inner periphery of the tip of the core member 301, and a covering member 303 made of plastic and formed to cover the outer periphery of the core member 301 and the cap member 302. Conductive metal plating is provided to the outer surface of the covering member 303 to form the roller electrode 31, so that the conduction between the roller electrode 31 and the bearing 34 is secured. A space 304 into which the bearing 34 is inserted is formed inside the core member 301. The stepped portion 305, which can be engaged with the engaging claw 341, is formed on the inner wall surface of the space 304. The bearing 34 is inserted and positioned in the space 304, and the engaging claw 341 is engaged with the stepped portion 305, so that the roller 3 is prevented from coming off from the bearing 34.

As shown in FIG. 16, the solar cell unit 11 has a negative electrode connection terminal 111 and a positive electrode connection terminal 112. The negative electrode connection terminal 111 is electrically and mechanically joined to the base plate 51 by a conductive screw 12 and a nut 13. In contrast, the positive electrode connection terminal 112 is attached to the inner wall surface of the handle upper portion 211 by a conductive screw 113. The handle upper portion 211 is also metal plated on its inner surface to form the handle electrode 213.

In this way, a conduction circuit is formed as follows. More specifically, the conduction circuit is formed by electrically connecting the solar cell unit 11, the negative electrode connection terminal 111, the conductive screw 12, the base plate 51, the torsion springs 421, the arm plate 61, the roller shafts 32, the bearings 34, the roller electrodes 31 of the rollers 3, the skin surface, the hand holding the handle upper portion 211, the handle electrode 213, the positive electrode connection terminal 112, and the solar cell unit 11 in the mentioned order. In this way, the conduction circuit is formed reliably, so that sufficient conduction performance is obtained.

The operation and advantages of the beauty device 104 according to the embodiment will be described in detail. The beauty device 104 according to the embodiment has for example a pivot mechanism inside the main body 2 and the number of portions is relatively large, so the dimensional error in the internal structure of the main body 2 may be large. Accordingly, a positional deviation may occur between the handle upper portion 211 and the handle lower portion 212 which form the main body 2. However, in the beauty device 104 according to the embodiment, the outer edge 216 of the handle upper portion 211 covers the outer edge of the handle lower portion 212 and the outer edge of the handle base 214, a gap is unlikely to form between the handle upper portion 211 and the handle lower portion 212 if a positional deviation occurs between the handle upper portion 211 and the handle lower portion 212. As a result, the intrusion of water or the like into the main body 2 is reduced, and the appearance of the device is enhanced. The beauty device 104 according to the embodiment provides equivalent operation and advantages as the first embodiment.

Confirmation Test 1

The following confirmation test 1 was performed.

The beauty device 104 according to the fourth embodiment was used as a test example, and a device having an equivalent feature to the beauty device 104 according to the fourth embodiment except that the arm portion 6 was fixed in the reference position without pivoting was used as a comparative example.

As for the test condition for confirmation test 1, the beauty devices according to the test example and the comparative example were used for five minutes while the devices were each move to reciprocate once every two seconds on the cheek of the subject, and the blood flow was measured using a two-dimensional blood flowmeter (OMEGA ZONE OZ-2 Pro manufactured by Muromachi Kikai Co., Ltd.) right before the use, right after the use, one minute after the use, five minutes after the use, and ten minutes after the use. The subjects were allowed to rest for 30 minutes and acclimated before measurement. Then, while the blood flow right before the use was set as 100%, the blood flow change rate at each timing was obtained. The subjects were six female subjects in their twenties to thirties (subjects 1 to 6), and the test results for the subjects are shown in Table 1 and FIG. 20.

TABLE 1

| | | Right before use (%) | Right after use (%) | 1 min after use (%) | 5 min after use (%) | 10 min after use (%) |
|---|---|---|---|---|---|---|
| Subject 1 | Comparative example | 100 | 157.1 | 153.0 | 171.4 | 151.4 |
| | Test example | 100 | 158.1 | 156.7 | 144.3 | 149.2 |
| Subject 2 | Comparative example | 100 | 125.3 | 119.2 | 125.7 | 114.8 |
| | Test example | 100 | 128.4 | 131.1 | 134.8 | 145.4 |
| Subject 3 | Comparative example | 100 | 118.3 | 109.1 | 104.5 | 109.1 |
| | Test example | 100 | 119.9 | 123.0 | 126.2 | 125.1 |
| Subject 4 | Comparative example | 100 | 127.6 | 126.2 | 123.9 | 121.3 |
| | Test example | 100 | 124.8 | 121.8 | 123.0 | 123.2 |
| Subject 5 | Comparative example | 100 | 119.4 | 117.6 | 117.3 | 118.9 |
| | Test example | 100 | 114.1 | 127.3 | 138.6 | 149.8 |
| Subject 6 | Comparative example | 100 | 121.5 | 120.4 | 121.6 | 116.1 |
| | Test example | 100 | 124.1 | 128.3 | 125.2 | 125.8 |

Figure 20:
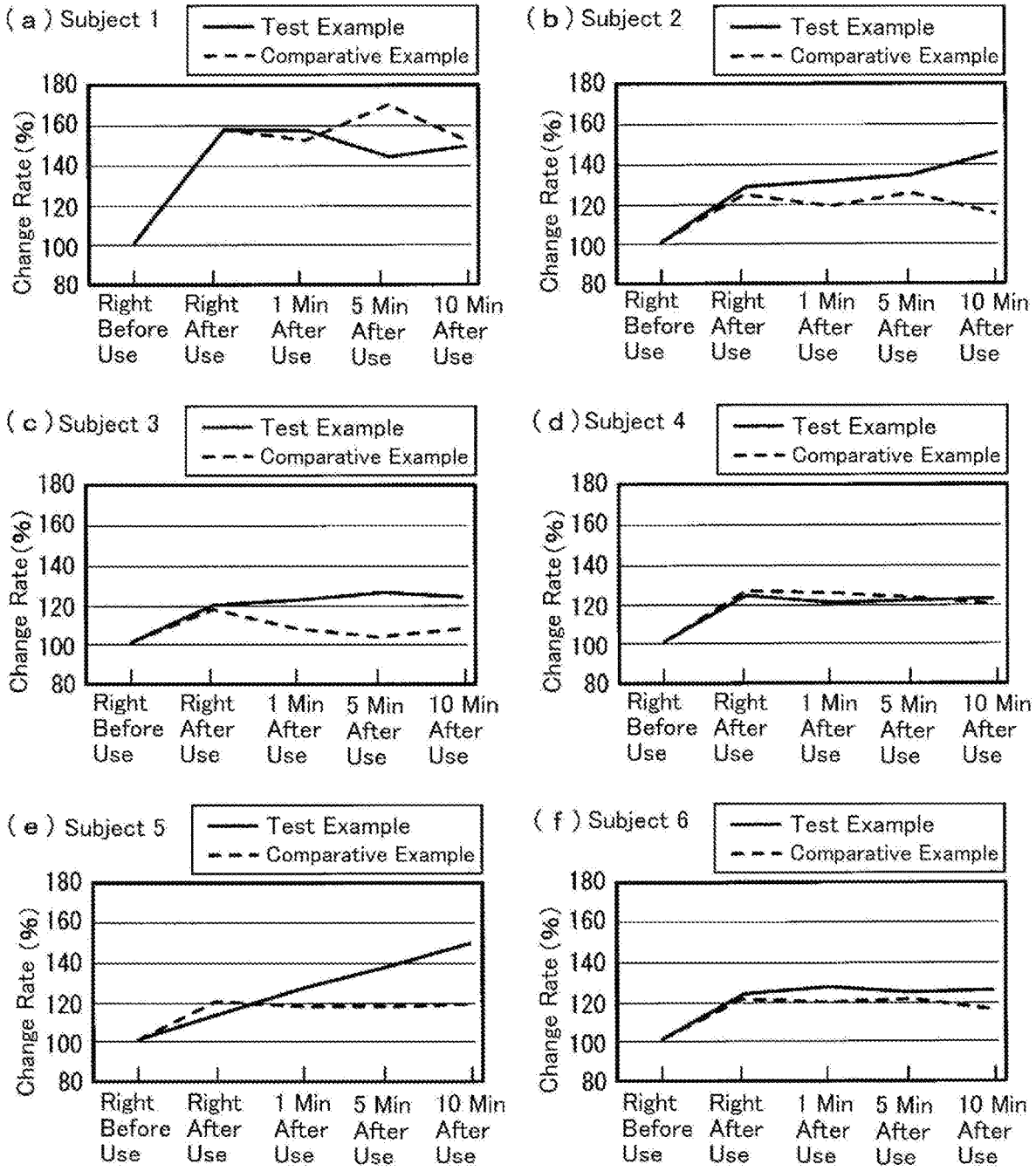
FIG. 20 shows the test result of confirmation test 1.

As shown in Table 1 and FIG. 20, it was found that the blood flow in the test examples was increased to be equal to or higher than that in the comparative examples. Therefore, in the test example, it was confirmed that the blood flow promoting effect equal to or higher than that of the comparative example can be obtained.

Confirmation Test 2

Then, the following confirmation test 2 was performed.

The test example and the comparative example were the same as those in the confirmation test 1.

As for the test condition of confirmation test 2, the beauty devices according to the test example and the comparative example were used for 30 seconds and each moved to reciprocate once every two seconds on the faces and the forearms of the subjects, and myoelectric potentials were measured at the brachioradialis muscle and superficial flexor muscles during the use. As the myoelectric potential increased, the muscle contraction strength and the strain on the muscle increased. The myogenic potential in the test example was compared while the myogenic potential in the comparative example was set as 100%. The subjects were two female subjects in their twenties to thirties (subjects 7 and 8) and one male subject in his twenties (subject 9), and the test results for the sites of the subjects subjected to the tests are shown in Table 2 and FIG. 21.

TABLE 2

| | | Face | | Forearm | |
|---|---|---|---|---|---|
| | | Brachioradialis muscle (%) | Superficial flexor muscles (%) | Brachioradialis muscle (%) | Superficial flexor muscles (%) |
| Subject 7 | Comparative example | 100 | 100 | 100 | 100 |
| | Test example | 53.3 | 45.4 | 40.3 | 39.7 |
| Subject 8 | Comparative example | 100 | 100 | 100 | 100 |
| | Test example | 80.57 | 54.23 | 80.6 | 54.2 |
| Subject 9 | Comparative example | 100 | 100 | 100 | 100 |
| | Test example | 58.14 | 45.79 | 58.1 | 45.8 |

Figure 21:
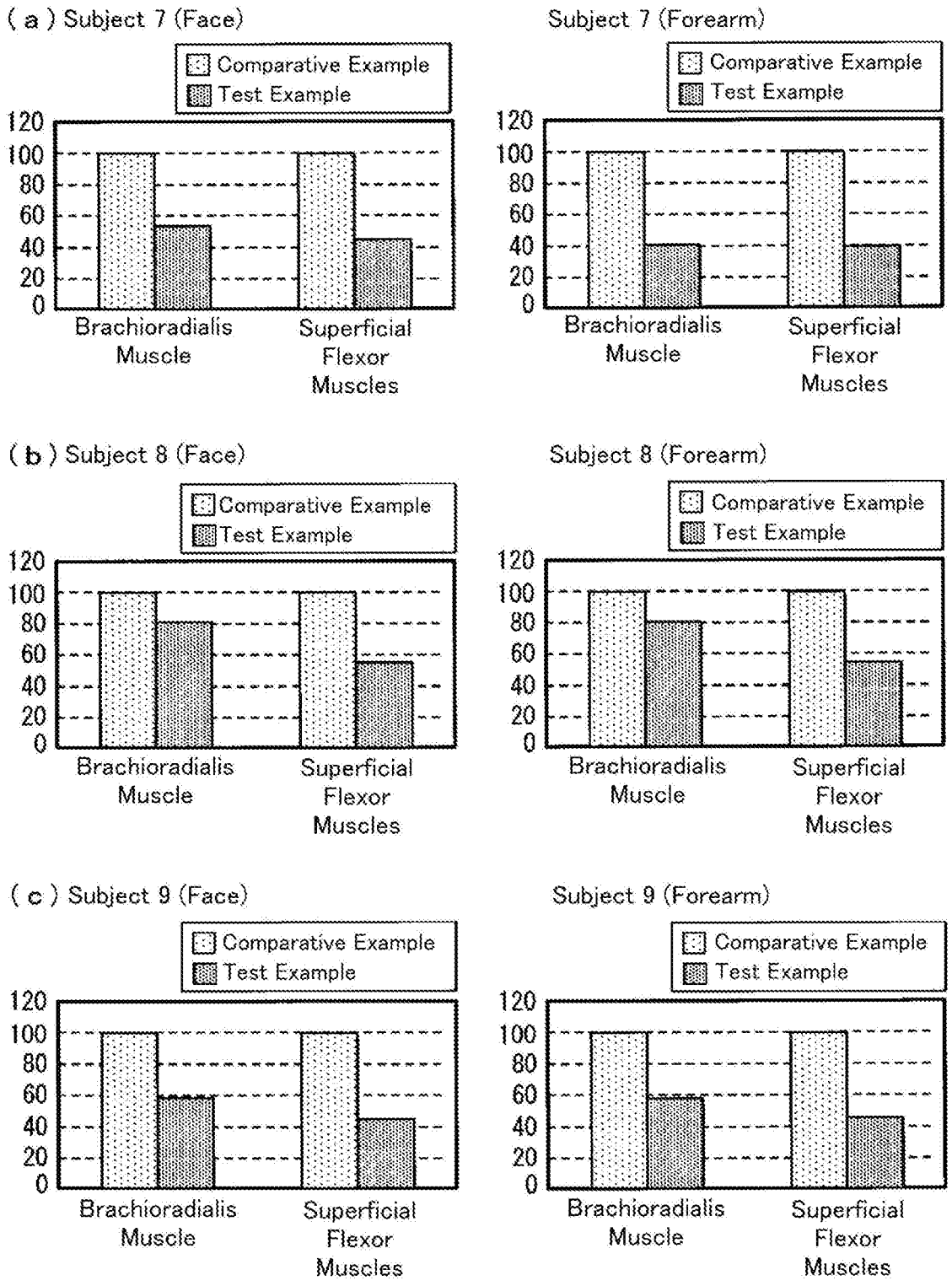
FIG. 21 shows the test result of confirmation test 2.

As shown in Table 2 and FIG. 21, it was found that in the test example, the amount of muscle contraction was smaller than that in the comparative example for all the test subjects and treated areas and the burden on the user's arm during use was reduced. Therefore, it was confirmed that the test example can be used more easily than the comparative example.

Fifth Embodiment

The beauty device 105 according to the present embodiment has a structure shown in FIGS. 22 to 29. Elements equivalent to those of the first to fourth embodiments are designated by the same reference characters, and their description will not be provided. According to the embodiment, similarly to the fourth embodiment, there is no mechanism for prohibiting the pivot movement of the arm portion 6 such as the lock switch 71 and the insertion piece 74 according to the first embodiment. Therefore, the arm portion 6 is kept in a constantly pivotal state.

Figure 26:
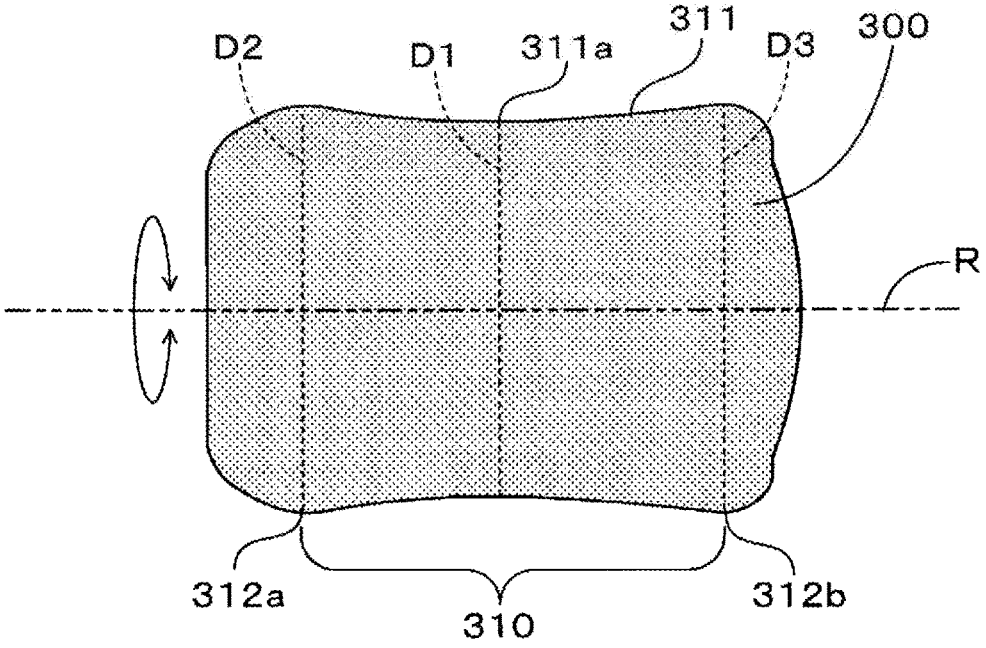
FIG. 26 is a diagram showing a locus of the roller according to the fifth embodiment.

According to the embodiment, as shown in FIG. 26, a locus 300 described by the roller 3 rotating around the rotation axis R has a diameter reduced portion 310 having a reduced diameter inwardly from opposite ends R1 and R2 in the rotation axis direction. The diameter reduced portion 310 has the smallest diameter D1 in the center position 311*a* in the rotation axis direction as viewed in a direction orthogonal to the rotation axis R. The diameters D2 and D3 at the opposite ends 312*a* and 312*b* in the rotation axis direction in the diameter reduced portion 310 are both larger than D1.

As shown in FIG. 26, the peripheral surface 311 of the diameter reduced portion 310 has an arcuate shape as viewed in a direction orthogonal to the rotation axis R. According to the embodiment, the entire diameter reduced portion 310 is in the form of an arcuate as viewed in a direction orthogonal to the rotation axis R and is smoothly continuous.

Figure 24:
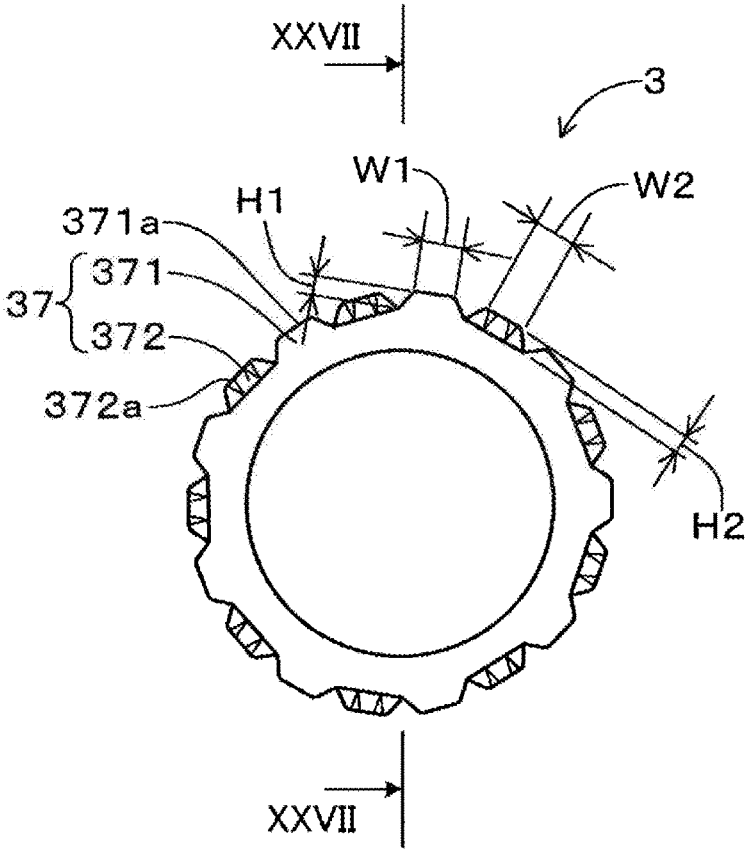
FIG. 24 is a side view of a roller according to the fifth embodiment.
Figure 25:
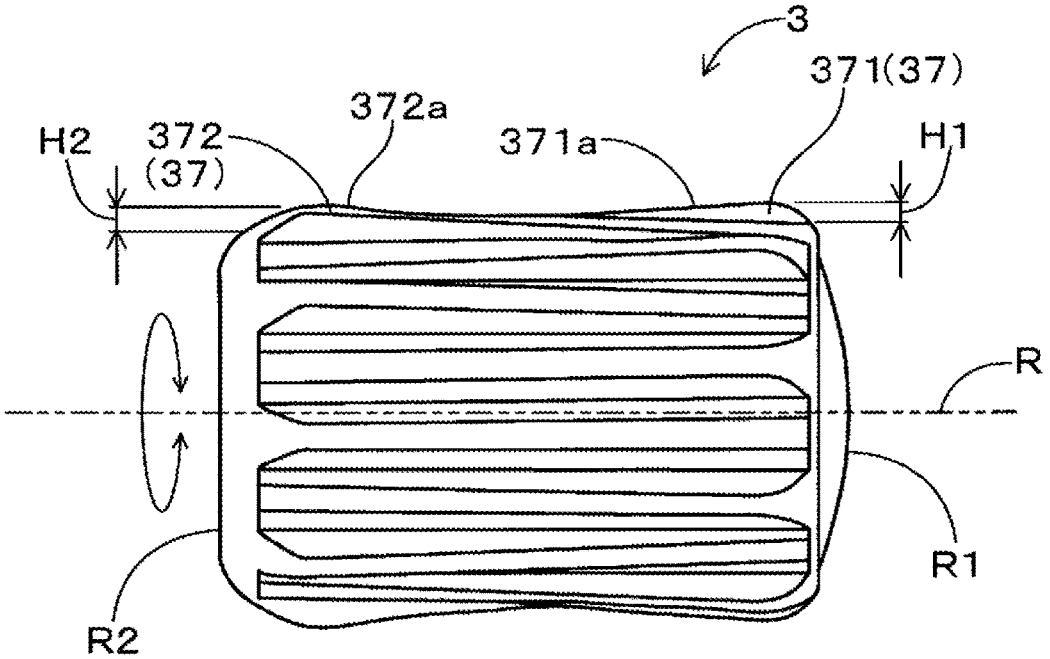
FIG. 25 is a plan view of the roller according to the fifth embodiment.

As shown in FIGS. 24 and 25, projections 37 are provided on the outer peripheral surface of the roller 3. The projections 37 extend along the rotation axis direction and project radially outwardly. The projections 37 are provided side by side in the circumferential direction and at least a portion of tops 371*a* and 372*a* of the projections 37 draws the diameter reduced portion 310 of the locus 300 shown in FIG. 26.

As shown in FIG. 24, the projections 37 include first projections 371 and second projections 372. As shown in FIG. 25, the top 371*a* of the first projection 371 approaches the rotation axis R from the first end R1 to the second end R2 opposite to the first end R1 in the rotation axis direction. The top 372*a* of the second projection 372 approaches the rotation axis R from the second end R2 to the first end R1 in the rotation axis direction. The projection heights H1 and H2 (see FIG. 24) of the first projection 371 and the second projection 372 can be set as appropriate. The projection height refers to the difference between the radial position of the projection and the position of the nearest portion to rotation axis R at the outer peripheral surface in a cross section orthogonal to the rotation axis direction.

According to the embodiment, as shown in FIG. 25, the projection height H1 decreases from the first end R1 toward the second end R2, and the projection height H2 decreases from the second end R2 toward the first end R1. Alternatively, while the projection heights H1 and H2 are kept constant, the first projection 371 may be formed so that the top 371*a* approaches the rotation axis R from the first end R1 toward the second end R2 and the second projection 372 may be formed so that the top 372*a* approaches the rotation axis R from the second end R2 toward the first end R1.

Figure 27:
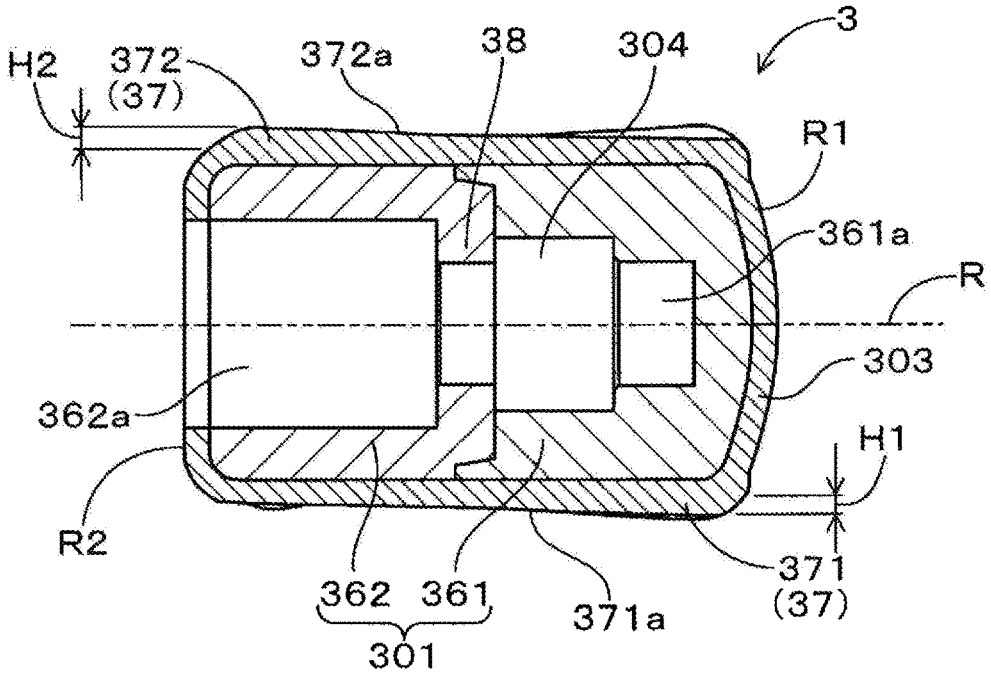
FIG. 27 is a cross-sectional view taken along line XXVII-XXVII in FIG. 24.

According to the embodiment, as shown in FIG. 24, the first and second projections 371 and 372 each have a trapezoidal shape as viewed in the direction of the rotation axis R. The widths W1 and W2 of the tops 371*a* and 372*a* of the first and second projections 371 and 372 corresponding to the upper side of the trapezoidal shape are constant in the rotation axis direction. The size of the widths W1 and W2 of the tops 371*a* and 372*a* can be set as appropriate. As shown in FIG. 27, the top 371*a* of the first projection 371 is gently curved to be slightly recessed toward the rotation axis R. Similarly, the top 372*a* of the second projection 372 is also gently curved to be slightly recessed toward the rotation axis R.

According to the embodiment, as shown in FIG. 24, the first projections 371 and the second projections 372 are alternately arranged in the circumferential direction. According to the embodiment, nine first projections 371 and nine second projections 372 are provided.

Figure 28:
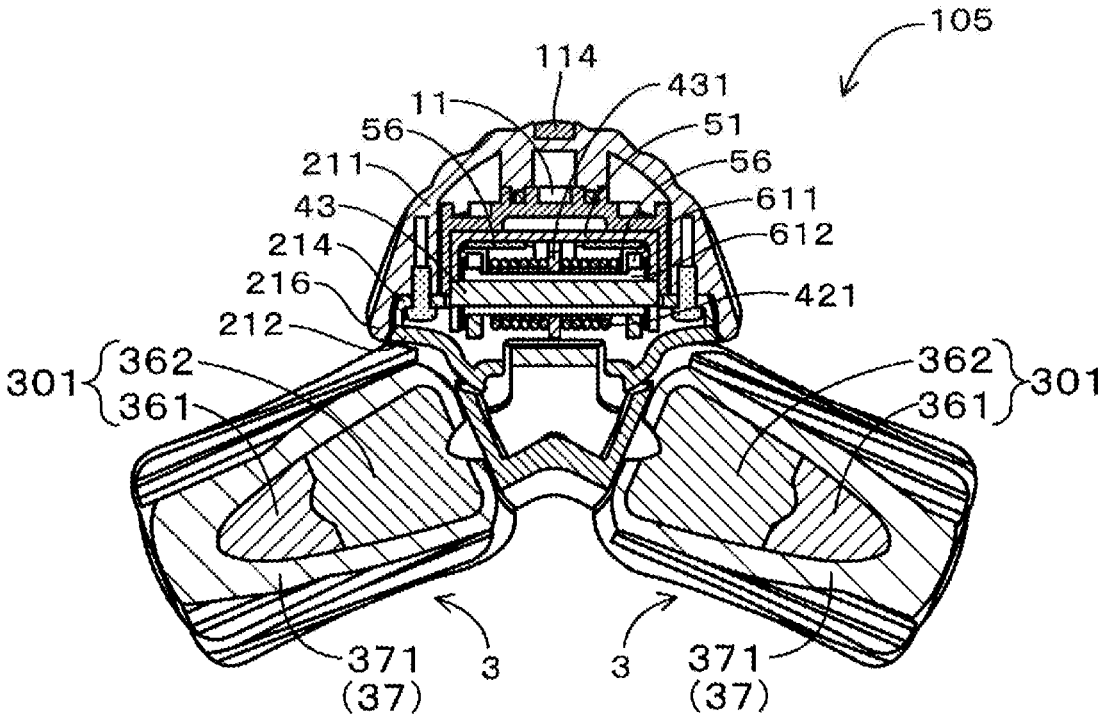
FIG. 28 is a cross-sectional view taken along line XXVIII-XXVIII in FIG. 22.
Figure 29:
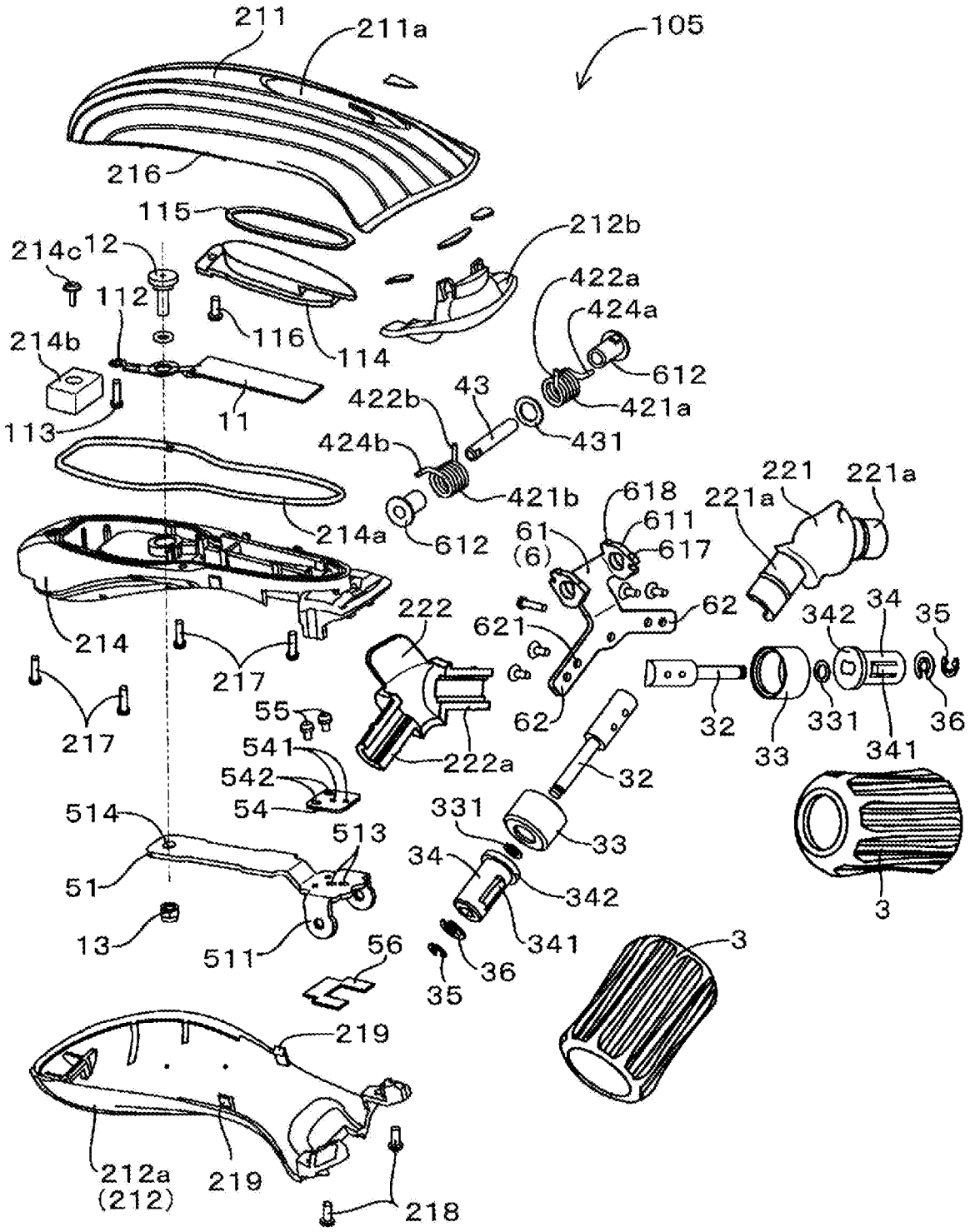
FIG. 29 is an exploded perspective view of the beauty device according to the fifth embodiment.

As shown in FIGS. 27 and 28, the core member 301 of the roller 3 is divided into a first core member 361 and a second core member 362 in the rotation axis direction. The first core member 361 has an inner space 361*a* in the form of a recess, and the second core member 362 has an inner space 362*a* in the form of a through hole. The first core member 361 and the second core member 362 are connected in the rotation axis direction, so that the inner space 361*a* and the inner space 362*a* communicate with each other. A stepped portion 38 bulging inwardly is formed in the second core member 362 located on the side of the main body 2 at a portion connected to the first core member 361. While the first core member 361 and the second core member 362 are connected, the outer surfaces of the members are covered with the covering member 303. The roller 3 is rotationally attached to the roller shaft 32 for example through the bearing 34 similarly to the fourth embodiment. As shown in FIG. 29, the roller shaft 32 is attached to the main body 2 through the arm portion 6.

Figure 22:
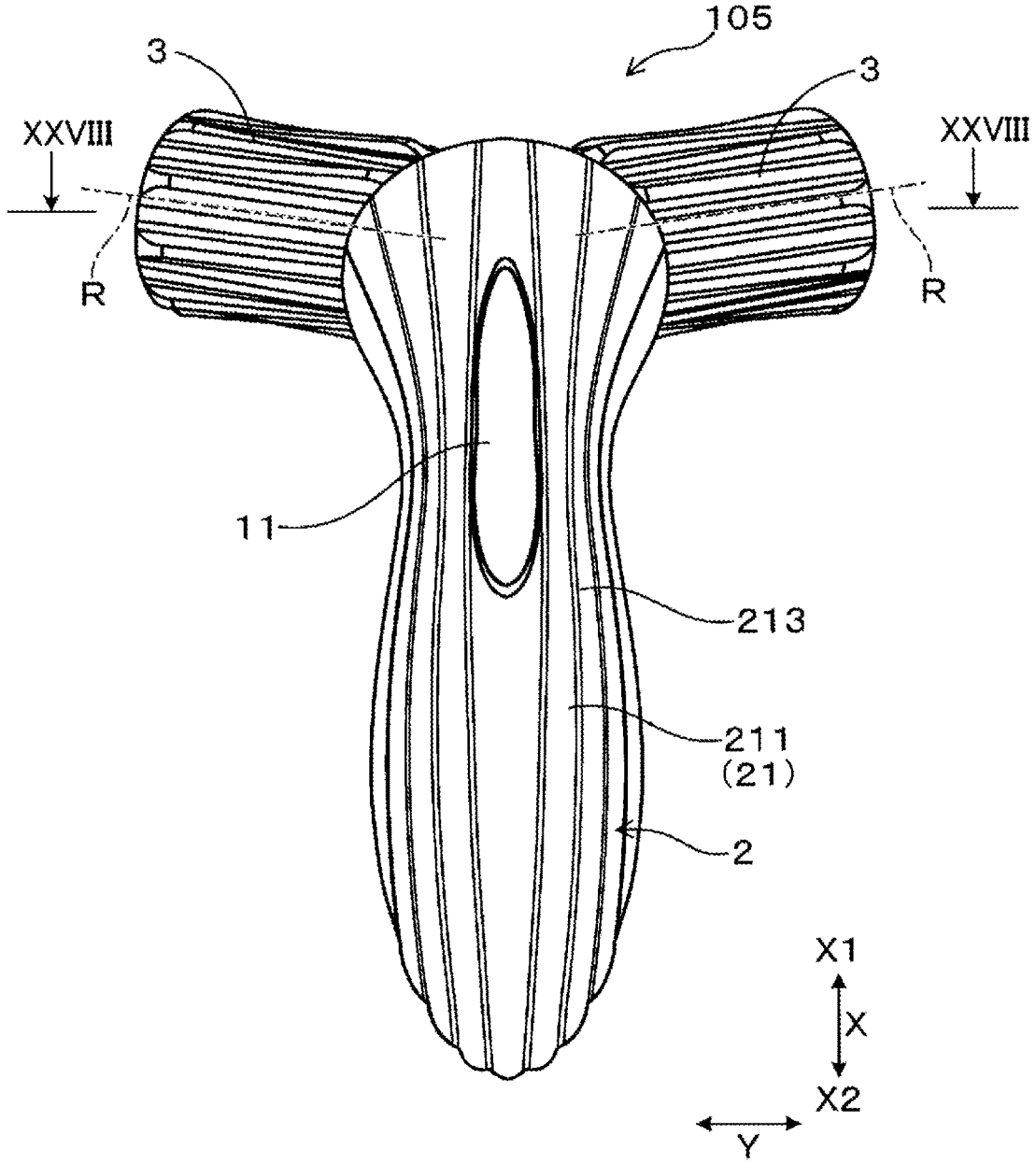
FIG. 22 is a plan view of a beauty device according to a fifth embodiment of the present invention.
Figure 23:
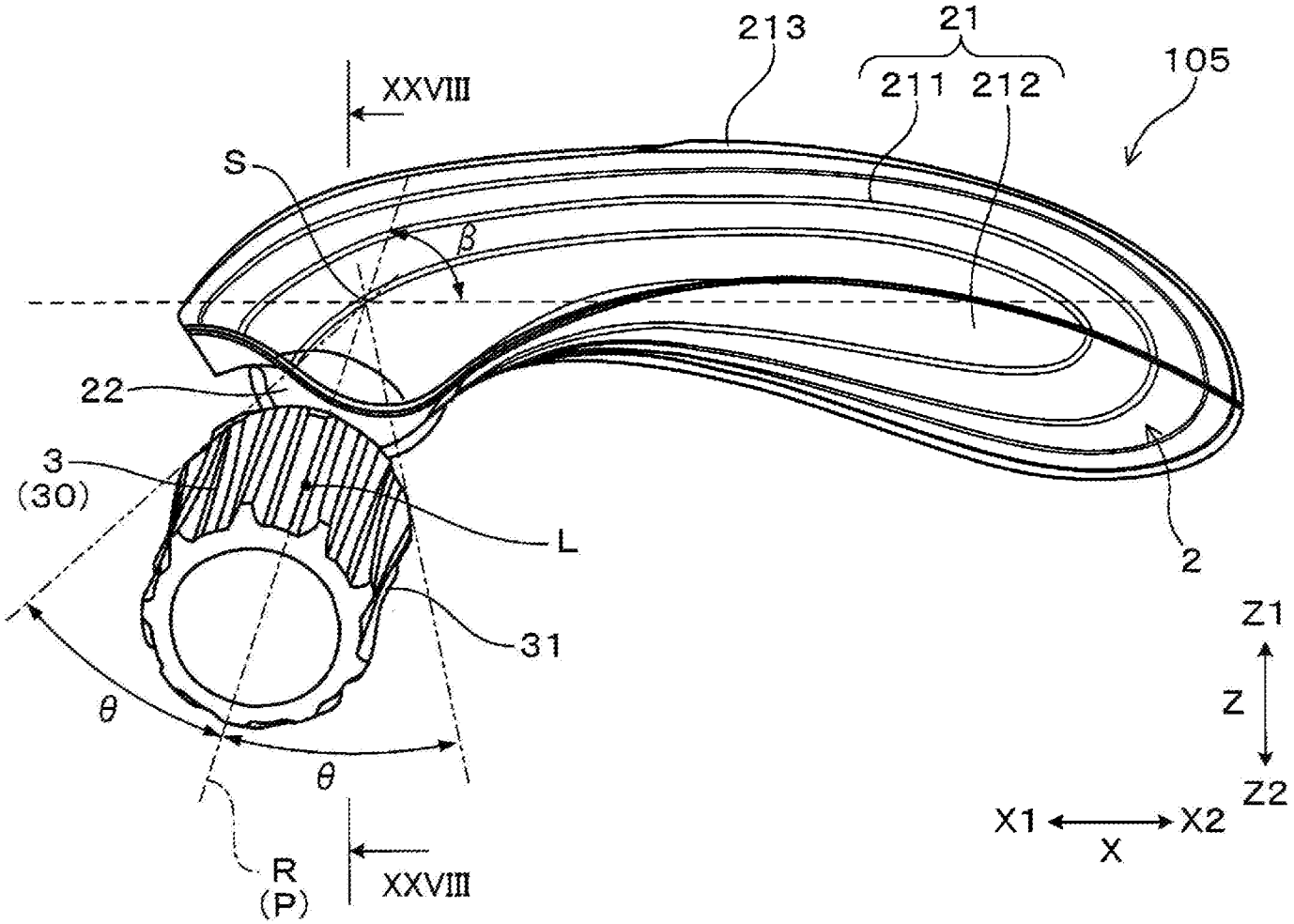
FIG. 23 is a side view of the beauty device according to the fifth embodiment.

As shown in FIG. 22, two rollers 3 are provided also according to the embodiment. The distance between the rotation axes R of the rollers 3 increases as the distance from the main body 2 increases. Similarly to the third embodiment, as shown in FIG. 23, the rotation axes R of the two rollers 3 are arranged on a common plane.

The operation and advantages of the beauty device 105 according to the embodiment will be described in detail.

In the beauty device 105 according to the embodiment, a locus 300 described by the roller 3 rotating around the rotation axis R has a diameter reduced portion 310 having a diameter inwardly reduced from opposite ends in the rotation axis direction, and therefore the diameter reduced portion 310 easily conforms to a gently bulging curved skin surface such as the skin of the face. This allows the roller 3 to be easily fitted to the skin surface, so that the massage effect is enhanced and feel in use is improved.

According to the embodiment, the peripheral surface 311 of the diameter reduced portion 310 has an arcuate shape as viewed in a direction orthogonal to the rotation axis R. This allows the diameter reduced portion 310 to more easily conform to a gently bulging curved skin surface such as a face. Therefore, the roller 3 is more easily fitted to the skin surface, so that the massage effect is enhanced and the feel in use is improved.

Also according to the embodiment, the diameter reduced portion 310 has the smallest diameter D1 in the center position 311*a* in the rotation axis direction as viewed in a direction orthogonal to the rotation axis R. This allows the diameter reduced portion 310 to more easily conform to a gently swelling, curved skin surface such as a face. Therefore, the roller 3 is more easily fitted to the skin surface, and the massage effect is enhanced and the feeling in use is improved.

According to the embodiment, the projections 37, which extend along the rotation axis and project radially outwardly, are provided side by side at the outer peripheral surface of the roller 3 in the circumferential direction. At least a portion of the tops 371*a* and 372*a* of the projections 37 draw the diameter reduced portion 310 of the locus 300. In this way, when the roller 3 is rotated and moved along the skin surface, the projections 37 can repeatedly press or pat the skin surface while the roller 3 is fitted to the skin surface. This further enhances the massage effect.

According to the embodiment, the projections 37 include the first projections 371 each having the top 371*a*, which approaches the rotation axis R from the first end R1 toward the second end R2 in the rotation axis direction, and the second projections 372 each having the top 372*a*, which approaches the rotation axis R from the second end R2 toward the first end R1. In this way, the skin surface is pressed or patted inwardly from the opposite sides in the rotation axis direction while the roller 3 is kept fitted to the skin surface, and the massage effect is further enhanced.

According to the embodiment, the first projections 371 and the second projections 372 are alternately arranged in the circumferential direction. In this way, the pressing or tapping action by the first projection 371 and the pressing or tapping action by the second projection 372 are alternately performed, so that the massage effect is further enhanced.

According to the embodiment, two rollers 3 are provided, and the distance between the rotation axes R increases as the distance from the main body 2 increases. In this way, as shown in FIG. 22, the two rollers 3 are moved to pick up the jaw and a cheek of the face from both sides while keeping the rollers 3 along these portions, so that the rollers 3 can be further fitted to the skin surface. As a result, the massage effect is further enhanced, and the user's bodily sensation is further enhanced.

According to the embodiment, the rotation axes R of the two rollers 3 are arranged on a common plane. In this way, the two rollers 3 are moved along the skin surface in the front-back direction, so that the two rollers 3 pick up the skin surface and provide a skin kneading effect.

According to the embodiment, the tops 371*a* and 372*a* of the first and second projections 371 and 372 are gently curved and slightly recessed toward the rotation axis R. Alternatively both of the tops 371*a* and 372*a* may be gently curved and slightly bulge to the opposite side to the rotation axis R or the tops 371*a* and 372*a* may be flat with no curved portions.

Also according to the embodiment, the first and second projections 371 and 372 have a trapezoidal shape as viewed in the direction of the rotation axis R. Alternatively, the first and second projections 371 and 372 may be formed to have a triangle, a hemisphere, a sector, a rectangle, a square, or a combination of any of these shapes as viewed in the direction of the rotation axis R.

According to the embodiment, while the first and second projections 371 and 372 both have a trapezoidal shape as viewed in the direction of the rotation axis R, the projections may have different shapes from each other. There may be a third projection having a shape different from the first projection 371 and the second projection 372.

Figure 30A:
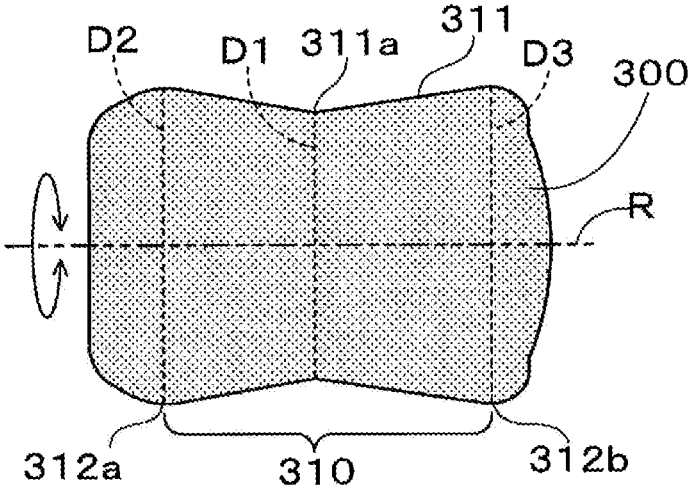
FIG. 30A is a diagram showing a locus of a roller according to a first modification.
Figure 30B:
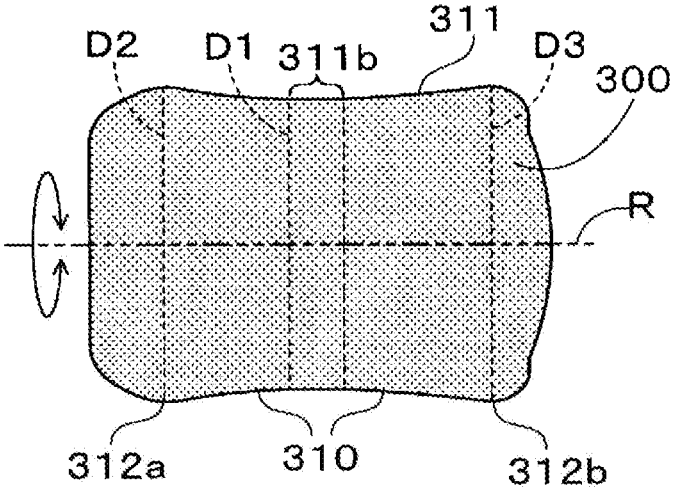
FIG. 30B is a diagram showing a locus of a roller according to a second modification.
Figure 30C:
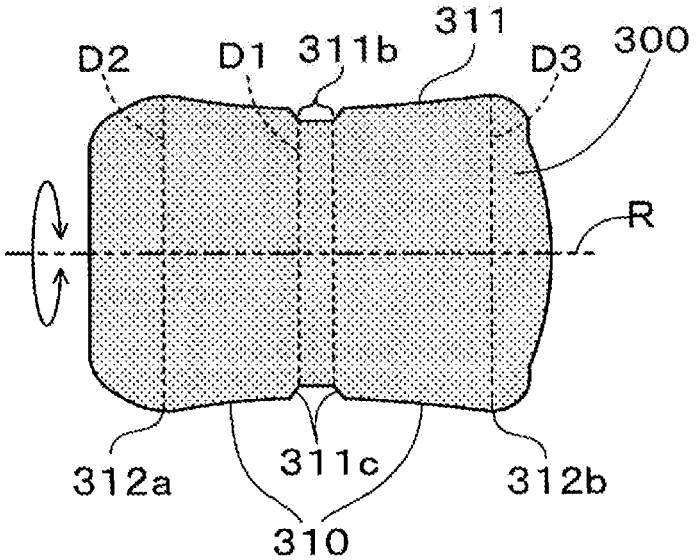
FIG. 30C is a diagram showing a locus of a roller according to a third modification.

As in a first modification shown in FIG. 30A, the outer edge of the diameter reduced portion 310 may have a straight shape from the opposite ends 312*a* and 312*b* toward the center position 311*a* as viewed in a direction orthogonal to the rotation axis R. The peripheral surface 311 may be angularly recessed in a position contacted by the linear portions (the center position 311*a* in the modification). As in a second modification as shown in FIG. 30B, there may be a flat center portion 311*b* in the central region, and the diameter reduced portions 310 may be formed separately on both sides of the center portion 311*b* in the rotation axis direction. As in a third modification as shown in FIG. 30C, the diameter reduced portion 310 may have its diameter reduced toward the inner side in the rotation axis direction and have a stepped portion continuous with the flat center portion 311*b*, and the diameter reduced portions 310 do not have to be smoothly continuous with the stepped portion 311*c* as viewed in a direction orthogonal to the rotation axis R. An equivalent operation and advantages as those according to the embodiment may be provided according to these first to third modifications. An equivalent operation and advantages as those according to the embodiment may be provided according to these modifications.

Confirmation Test 3

The following confirmation test 3 was performed. The test subjects were as follows.

The beauty device 105 according to the fifth embodiment was used as a test example.

Figure 31A:
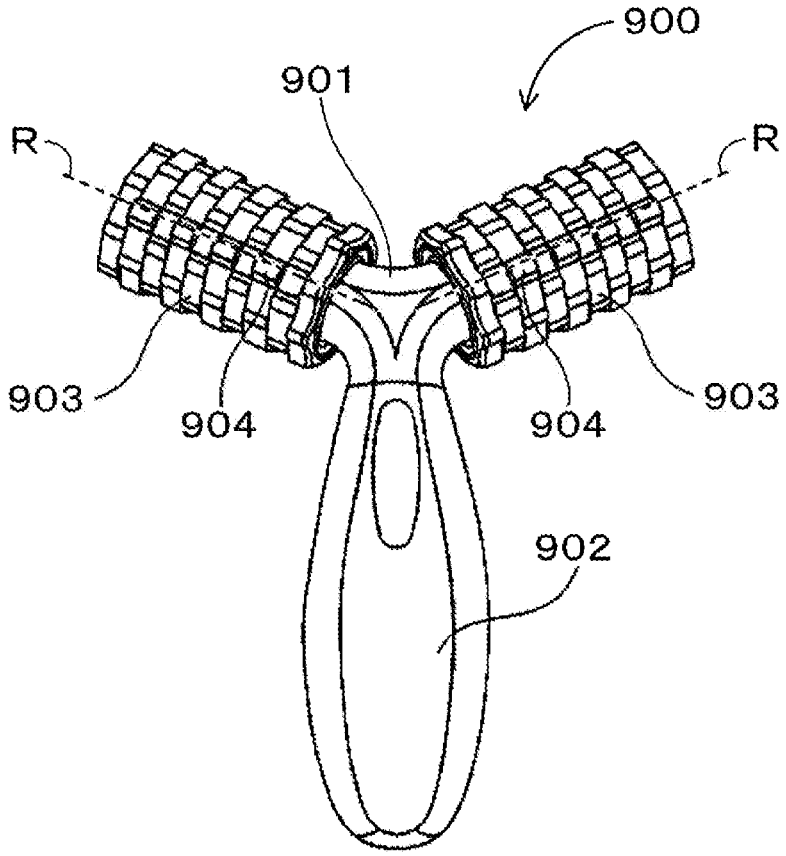
FIG. 31A is a plan view of a beauty device according to a first comparative example.

A conventional beauty device 900 as shown in FIG. 31A was used as a first comparative example.

A device having an equivalent feature to that of the beauty device 105 according to the fifth embodiment except that the arm portion 6 was fixed in the reference position and did not pivot was used as a second comparative example.

A device having an equivalent feature to the beauty device 105 according to the fifth embodiment except that the arm portion 6 is pivotal in the left-right direction was used as a third comparative example.

Figure 31B:
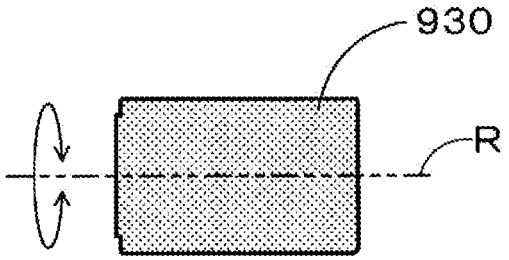
FIG. 31B is a diagram showing a locus of a roller according to the first comparative example.

The conventional beauty device 900 shown in FIG. 31A includes two rollers 903 rotationally provided at a branch portion 901 at the tip of the handle 902. The branch portion 901 does not have a pivot mechanism, and the roller 903 cannot pivot. Although protrusions 904 are provided on the outer peripheral surface of the roller 903, a locus described by axial rotation around the rotation axis R is a cylindrical shape as shown in FIG. 31B having a fixed shape in the rotation axis direction and does not have a diameter reduced portion whose diameter decreases inwardly in the rotation axis direction.

The test condition for confirmation test 3 was as follows. The beauty devices according to the test example and the first to third comparative examples were used for five minutes on the cheek of each subject and each moved to reciprocate once every two seconds, and the blood flow was measured right before the use, right after the use, one minute after the use, five minutes after the use, and ten minutes after the use using a two-dimensional blood flowmeter (OMEGA ZONE OZ-2Pro manufactured by Muromachi Kikai Co., Ltd.). The subjects were allowed to rest for 30 minutes and acclimated before the measurement. The strength to press each of the beauty devices against the cheek was the strength which allowed the subject to feel a feeling. The definition of the amount of change in blood flow was the same as that in the confirmation test 1. The subjects were eight female subjects and one male subject, nine subjects in total, aged 26 to forties, and the average values of the measurement values of the subjects are shown in Table 3 and FIG. 32.

TABLE 3

| | Right before use (%) | Right after use (%) | 1 min after use (%) | 5 min after use (%) | 10 min after use (%) |
|---|---|---|---|---|---|
| Comparative example 1 | 100 | 116.9 | 117.4 | 116.8 | 117.12 |
| Comparative example 2 | 100 | 114.5 | 114.6 | 114.3 | 114.4 |
| Comparative example 3 | 100 | 115.4 | 117.9 | 114.6 | 114.5 |
| Test example | 100 | 117.9 | 117.8 | 119.5 | 119.9 |

Figure 32:
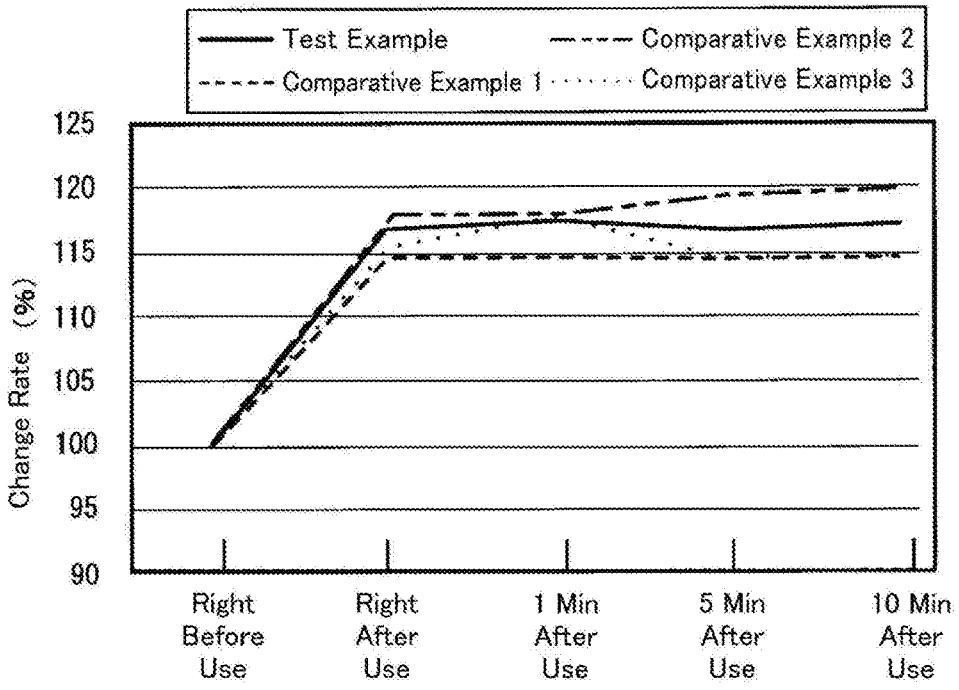
FIG. 32 shows the result of a confirmation test 3.

As shown in Table 3 and FIG. 32, it was found that the blood flow in the test example was increased to be equal to or higher than the first to third comparative examples. Therefore, it was confirmed that in the test example, a blood flow promotion effect equal to or higher than the comparative examples can be provided.

Confirmation Test 4

The following confirmation test 4 was performed.

The test example, the first to third comparative examples, and the subjects were the same as those in the confirmation test 3.

The test condition for confirmation test 4 was the same as the confirmation test 3, and skin elasticity was measured using a skin viscoelasticity measuring device (Cutometer DUAL MPA580 manufactured by Courage+Khazaka electronic GmbH) instead of measuring blood flows. The change rate in skin elasticity five minutes after the use was calculated for every subject when the value of the skin elasticity right before the use was set as 100%, and the average value of the change rates for all the subjects was calculated as given in Table 4 and FIG. 33.

TABLE 4

| Right before use (%) | Comparative example 1 (%) | Comparative example 2 (%) | Comparative example 3 (%) | Test example (%) |
|---|---|---|---|---|
| 100 | 114.4 | 115.3 | 114.8 | 118.4 |

Figure 33:
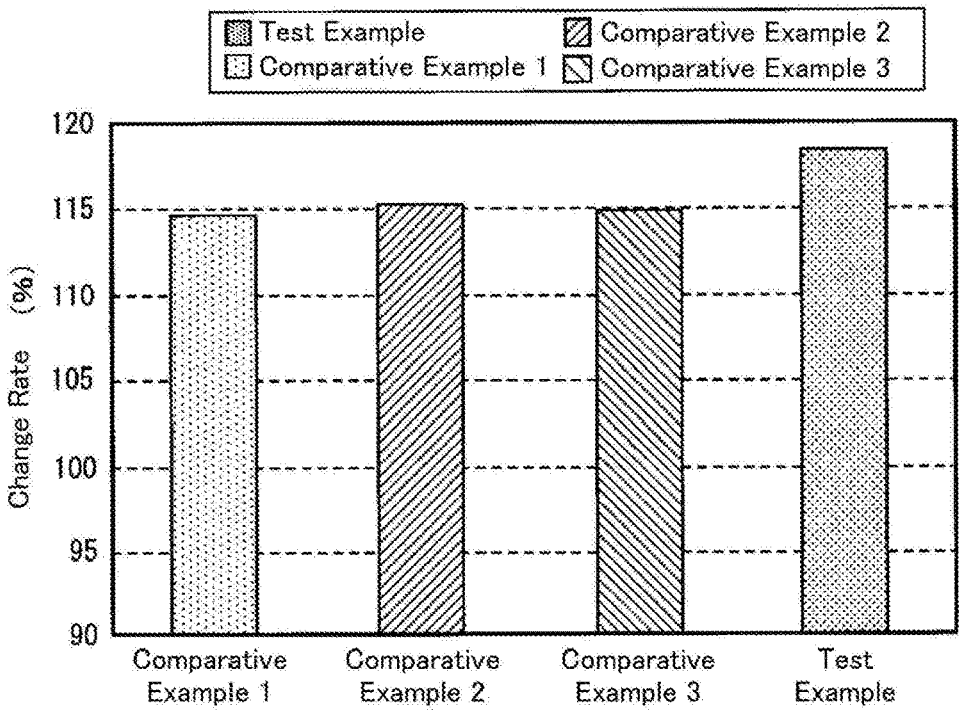
FIG. 33 shows the result of a confirmation test 4.

As shown in Table 4 and FIG. 33, in the test example, the change rate in skin elasticity was higher than that in the first to third comparative examples. Therefore, it was confirmed that the beauty device according to the test example enhances the massage effect and the skin elasticity can be maintained at a high level as compared with the beauty devices according to the first to third comparative examples.

The invention claimed is:

1. A beauty device comprising:

a main body including a handle portion to be held by a user;

an arm portion provided to be pivotal relative to the main body around a pivot axis;

two rollers rotationally held at the arm portion; and a spring that urges the arm portion toward a reference position within a range of a pivot movement, wherein the two rollers are arranged in a width direction, the pivot axis extends in the width direction, the two rollers have rotation axes that are arranged such that a distance between the rotation axes increases as a distance from the main body increases, the beauty device is configured such that when the beauty device is moved to reciprocate while the two rollers are pressed against a skin of the user, the two rollers pick up the skin of the user both in a forward path and a return path, wherein the rotation axes of the two rollers are pivotable so that:

when the beauty device is moved along the skin of the user in a direction of the forward path, an angle open toward a front side of the beauty device and formed between each of the rotation axes and the direction of the forward path is an obtuse angle, and when the beauty device is moved along the skin of the user in a direction of the return path, an angle open toward a back side of the beauty device and formed between each of the rotation axes and the direction of the return path is an obtuse angle.

2. The beauty device of claim 1, further comprising a shaft interposed between the main body and the arm portion to allow the arm portion to pivot relative to the main body.

3. The beauty device of claim 2, comprising a roller holder including the arm portion, the shaft, and the spring.

4. The beauty device of claim 1, wherein the arm portion is pivotal relative to the main body in a direction along the forward path and the return path.

5. The beauty device of claim 1, wherein the rotation axes of the two rollers are arranged on a common plane.

6. The beauty device of claim 1, wherein a locus described by each roller rotating around a respective one of the rotation axes has a diameter reduced portion having a diameter inwardly reduced from opposite ends in a rotation axis direction.

7. A beauty device comprising:

a main body including a handle portion to be held by a user;

an arm portion provided to be pivotal relative to the main body around a pivot axis;

two rollers rotationally held at the arm portion; and a spring that urges the arm portion toward a reference position within a range of a pivot movement, wherein the two rollers are arranged in a width direction, the pivot axis extends in the width direction, the width direction is orthogonal to a front-back direction, the arm portion is pivotal to a front side from the reference position, the arm portion is pivotal to a back side from the reference position, a pivot movement of the arm portion to the front side from the reference position causes rotation axes of the two rollers to be inclined forward relative to the rotation axes in the reference position, a pivot movement of the arm portion to the back side from the reference position causes the rotation axes of the two rollers to be inclined backward relative to the rotation axes in the reference position, the rotation axes of the two rollers are arranged such that a distance between the rotation axes increases as a distance from the main body increases, wherein the rotation axes of the two rollers are pivotable so that:

when the beauty device is moved along a skin of the user in a direction of a forward path, an angle open toward the front side of the beauty device and formed between each of the rotation axes and the direction of the forward path is an obtuse angle, and when the beauty device is moved along the skin of the user in a direction of a return path, an angle open toward the back side of the beauty device and formed between each of the rotation axes and the direction of the return path is an obtuse angle.

8. A beauty device comprising:

a main body including a handle portion to be held by a user;

an arm portion provided to be pivotal relative to the main body around a pivot axis;

a shaft interposed between the main body and the arm portion to allow the arm portion to pivot relative to the main body, the shaft being provided on the pivot axis, two rollers rotationally held at the arm portion; and at least one torsion spring that urges the arm portion toward a reference position within a range of a pivot movement, the torsion spring being arranged about the shaft, wherein the rotation axes of the two rollers are pivotable so that:

when the beauty device is moved along a skin of the user in a direction of a forward path, an angle open toward a front side of the beauty device and formed between each of the rotation axes and the direction of the forward path is an obtuse angle, and when the beauty device is moved along the skin of the user in a direction of a return path, an angle open toward a back side of the beauty device and formed between each of the rotation axes and the direction of the return path is an obtuse angle.

9. The beauty device of claim 8, wherein the two rollers are arranged in a width direction, the pivot axis extends in the width direction, the width direction is orthogonal to a front-back direction, the arm portion is pivotal to a front side from the reference position, the arm portion is pivotal to a back side from the reference position, the at least one torsion spring includes a first torsion spring and a second torsion spring that are arranged side by side in the width direction, the first torsion spring and the second torsion spring each include a coil portion and an end that extends from the coil portion in the width direction, when the arm portion pivots to the front side from the reference position, a position of the end of the first torsion spring and a position of the end of the second torsion spring are turned so that the coil portion of the first torsion spring is rewound and the coil portion of the second torsion spring is enwound, and when the arm portion pivots to the back side from the reference position, the position of the end of the first torsion spring and the position of the end of the second torsion spring are turned so that the coil portion of the first torsion spring is enwound and the coil portion of the second torsion spring is rewound.

10. The beauty device of claim 8, wherein the two rollers have the rotation axes arranged such that a distance between the rotation axes increases as a distance from the main body increases.

* * * * *